US012232618B2

(12) United States Patent
Crawford et al.

(10) Patent No.: US 12,232,618 B2
(45) **Date of Patent: *Feb. 25, 2025**

(54) SLIM-PROFILE, ALL-LINKAGE, WALL-PROXIMITY RECLINING MECHANISM ALLOWING A WOOD-TO-FLOOR RECLINER SEATING UNIT

(71) Applicant: L&P PROPERTY MANAGEMENT COMPANY, South Gate, CA (US)

(72) Inventors: Cheston Brett Crawford, Randolph, MS (US); Gregory Mark Lawson, Tupelo, MS (US)

(73) Assignee: L&PProperty Management Company, South Gate, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/235,939

(22) Filed: Aug. 21, 2023

(65) Prior Publication Data

US 2023/0397727 A1 Dec. 14, 2023

Related U.S. Application Data

(63) Continuation of application No. 17/726,215, filed on Apr. 21, 2022, now Pat. No. 11,766,124.
(Continued)

(51) Int. Cl.
*A47C 1/02* (2006.01)
*A47C 1/024* (2006.01)
(Continued)

(52) U.S. Cl.
CPC ..... *A47C 1/0355* (2013.01)

(58) Field of Classification Search
CPC ... A47C 1/0355; A47C 1/0352; A47C 1/0345; A47C 1/03211; A47C 1/024; A47C 1/0242
See application file for complete search history.

(56) References Cited

U.S. PATENT DOCUMENTS 3,284,131 A 11/1966 Fletcher
3,637,255 A 1/1972 Re
(Continued)

FOREIGN PATENT DOCUMENTS

CN 102905580 A 1/2013
CN 106263778 A 1/2017
(Continued)

OTHER PUBLICATIONS

International Search Report and Written Opinion received for PCT Patent Application No. PCT/US2022/026312, mailed on Sep. 8, 2022, 17 pages.
(Continued)

*Primary Examiner* — Shin H Kim
(74) *Attorney, Agent, or Firm* — Shook, Hardy & Bacon L.L.P.

(57) ABSTRACT

A simplified, compact, recliner mechanism is provided which can be adapted to many types of recliner design. A front linkage assembly and a rear linkage assembly provide the desired movement of the seat and back when moving from the TV position to the fully reclined position, obviating the need for a track and roller design. Moreover, a front pivot link and a rear pivot link are provided and oriented in a manner that allows the desired forward seat movement as the recliner moves from the closed position to the TV position. The geometries of the front linkage assembly, the rear linkage assembly, the front pivot link and the rear pivot link allow a slim profile design allowing great flexibility in the design of the recliner.

20 Claims, 34 Drawing Sheets

Related U.S. Application Data

(60) Provisional application No. 63/180,975, filed on Apr. 28, 2021.

(51) Int. Cl.
*A47C 1/0355* (2013.01)
*A47C 7/50* (2006.01)

(56) References Cited

U.S. PATENT DOCUMENTS

| | | | | |
|---|---|---|---|---|
| 5,971,475 | A | 10/1999 | Lawson et al. | |
| 7,641,277 | B2 * | 1/2010 | Lawson | A47C 1/0352 297/85 L |
| 8,419,122 | B2 | 4/2013 | Lawson et al. | |
| 8,696,054 | B2 * | 4/2014 | Crum | A47C 1/0355 297/85 M |
| 10,512,333 | B2 | 12/2019 | Lawson et al. | |
| 11,229,290 | B1 * | 1/2022 | Bryant | A47C 1/03294 |
| 11,266,245 | B2 * | 3/2022 | Lawson | A47C 1/0355 |
| 11,278,120 | B2 | 3/2022 | Bryant | |
| 2002/0125746 | A1 | 9/2002 | Gaffney et al. | |
| 2009/0174251 | A1 | 7/2009 | Lawson et al. | |
| 2011/0175404 | A1 | 7/2011 | Lawson | |
| 2012/0299363 | A1 | 11/2012 | Crum | |
| 2013/0257111 | A1 | 10/2013 | Wiecek | |
| 2015/0289655 | A1 | 10/2015 | Lawson | |
| 2016/0022040 | A1 | 1/2016 | Lawson | |
| 2018/0027968 | A1 | 2/2018 | Lawson et al. | |
| 2018/0103761 | A1 | 4/2018 | White et al. | |
| 2018/0161223 | A1 | 6/2018 | Murphy | |
| 2020/0275781 | A1 | 9/2020 | Lawson et al. | |
| 2022/0015543 | A1 | 1/2022 | Bryant | |
| 2022/0167745 | A1 * | 6/2022 | Lawson | A47C 1/0355 |
| 2022/0346552 | A1 | 11/2022 | Crawford et al. | |

FOREIGN PATENT DOCUMENTS

| | | | |
|---|---|---|---|
| CN | 107660910 | A | 2/2018 |
| CN | 209436695 | U | 9/2019 |
| CN | 113040555 | A | 6/2021 |
| EP | 3718438 | A1 | 10/2020 |

OTHER PUBLICATIONS

Invitation to Pay Additional Fees received for PCT Patent Application No. PCT/US2022/026312, mailed on Jul. 15, 2022, 2 pages.
International Preliminary Report on Patentability received for PCT Patent Application No. PCT/US2022/026312, mailed on Nov. 9, 2023, 8 pages.
Office Action received for Chinese Patent Application No. 202210499469.9, mailed on May 25, 2024, 10 pages (6 pages of Original OA and 4 pages of English Translation).

* cited by examiner

SLIM-PROFILE, ALL-LINKAGE, WALL-PROXIMITY RECLINING MECHANISM ALLOWING A WOOD-TO-FLOOR RECLINER SEATING UNIT

CROSS REFERENCE TO RELATED APPLICATION

This application, entitled "SLIM-PROFILE, ALL-LINKAGE, WALL-PROXIMITY RECLINING MECHANISM ALLOWING A WOOD-TO-FLOOR RECLINER SEATING UNIT" is a continuation of pending U.S. application Ser. No. 17/726,215, entitled "SLIM-PROFILE, ALL-LINKAGE, WALL-PROXIMITY RECLINING MECHANISM ALLOWING A WOOD-TO-FLOOR RECLINER SEATING UNIT", and filed on Apr. 22, 2022. The aforementioned application is incorporated herein by reference in its entirety.

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "recliners." More particularly, the present invention relates to an improved all-linkage powered reclining mechanism allowing a high-leg styling (with its slim profile) and a wood-to-the-floor design.

Recliners exist that utilize a front and a rear track and roller design to move a seat forward as the recliner moves to the TV position and the fully reclined position. However, the track and roller design offers certain drawbacks in part longevity and in the clearances required by the design. These existing recliners typically provide three basic positions: a normal non-reclined sitting position with the seat generally horizontal and the back substantially upright; a partially reclined position often referred to as a "TV" position wherein the seat and back are disposed in a slightly reclined position but with the back still sufficiently upright to permit comfortable television viewing from the recliner; and a fully reclined position wherein the back is pivoted toward horizontal into an obtuse relationship with the seat for lounging or sleeping. However, it would be desirable to allow a similar motion without the need for the track and roller design. It would also be desirable to provide a recliner mechanism with a low profile that allows a high-leg styling and a wood-to-the-floor design, while still providing a recliner that can be positioned with the back relatively close to the wall. Further, it would be desirable to provide a basic recliner mechanism design that could be used on a variety of different recliners with only minimal part changes that allows for efficiencies in manufacturing.

BRIEF SUMMARY OF THE INVENTION

One aspect of the present invention seeks to provide a simplified, compact, recliner mechanism which can be adapted to many types of recliner design. At a high level, a front linkage assembly and a rear linkage assembly provide the desired movement of the seat and back when moving from the TV position to the fully reclined position, obviating the need for a track and roller design, and all the deficiencies associated therewith. Moreover, a front pivot link and a rear pivot link are provided and oriented in a manner that allows the desired forward seat movement as the recliner moves from the closed position to the TV position. The geometries of the front linkage assembly, the rear linkage assembly, the front pivot link and the rear pivot link allow a slim profile design allowing great flexibility in the design of the recliner.

With only minimal changes the recliner mechanism allows for an increased seat pitch (to allow positioning in a "zero-gravity" position with the front of the seat moving upwardly more than the rear of the seat in the TV and fully reclined positions). Similarly minimal changes allow a "high-ottoman" design, a spring-loaded ottoman design, a "deep seat" design, and a design with either a short back or a long back. In other aspects, a two-motor design is possible that allows a variable seat pitch, with independent movement of the footrest linkage from the seat and the back.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
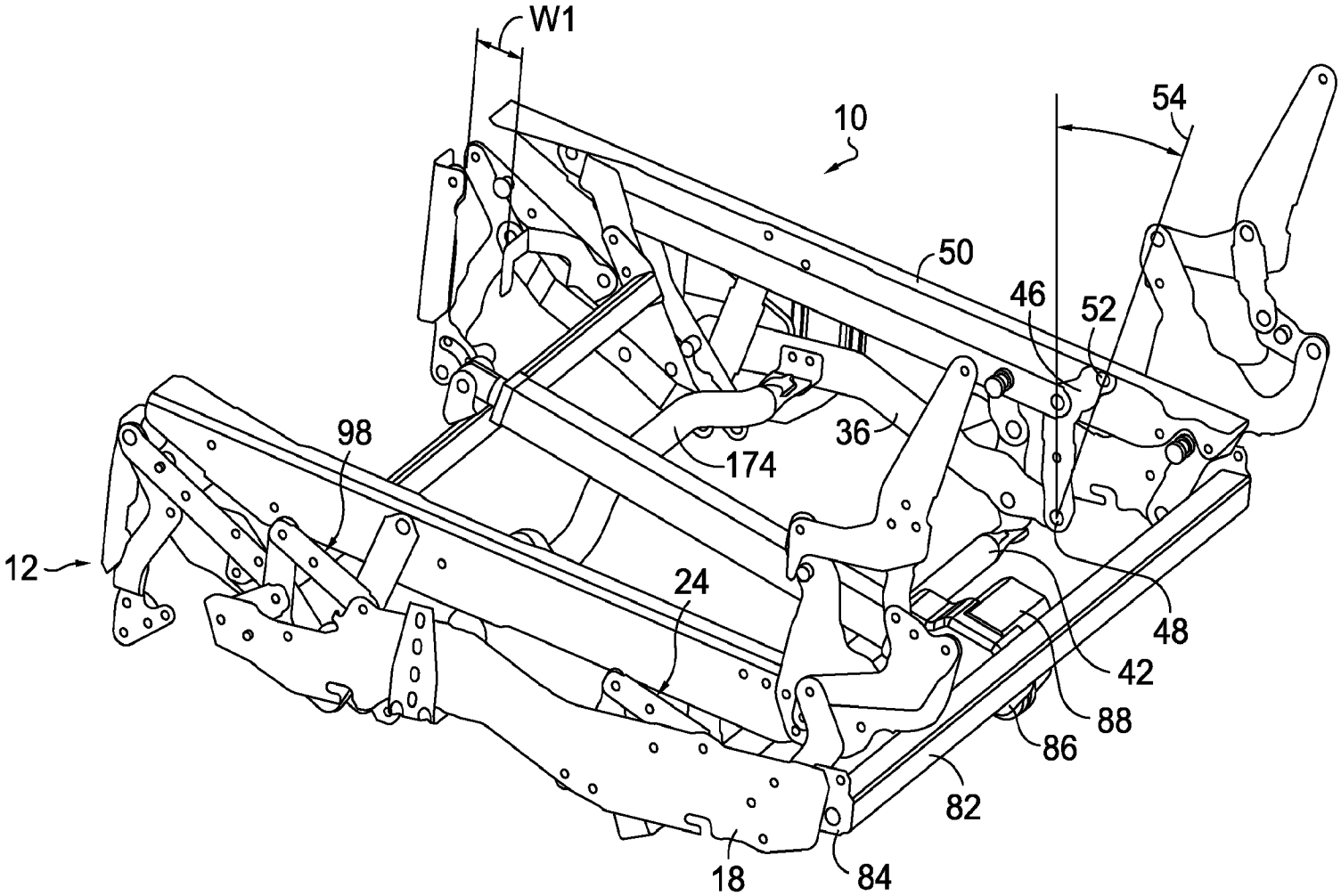
FIG. 1 is a perspective view of a recliner mechanism in a closed position, in accordance with aspects hereof.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other present or future technologies. Further, it should be appreciated that the figures do not necessarily represent an all-inclusive representation of the embodiments herein and may have various components hidden to aid in the written description thereof.

Aspects hereof may be described using directional terminology. For example, the Cartesian coordinate system may be used to describe positions and movement or rotation of the features described herein. Accordingly, some aspects may be described with reference to three mutually perpendicular axes. The axes may be referred to herein as lateral, longitudinal, and vertical, and may be indicated by reference characters X, Y, and Z, respectively, in the accompanying figures. For example, the terms "vertical" and "vertically" as used herein refer to a direction perpendicular to each of the lateral and longitudinal axes. As a further example, the longitudinal axis may extend in a front-to-back direction of a recliner and the lateral axis may extend in a side-to-side direction of the recliner. Additionally, relative location terminology will be utilized herein. For example, the term "proximate" is intended to mean on, about, near, by, next to, at, and the like. Therefore, when a feature is proximate another feature, it is close in proximity but not necessarily exactly at the described location, in some aspects. Additionally, the term "distal" refers to a portion of a feature herein that is positioned away from a midpoint of the feature.

Figure 2:
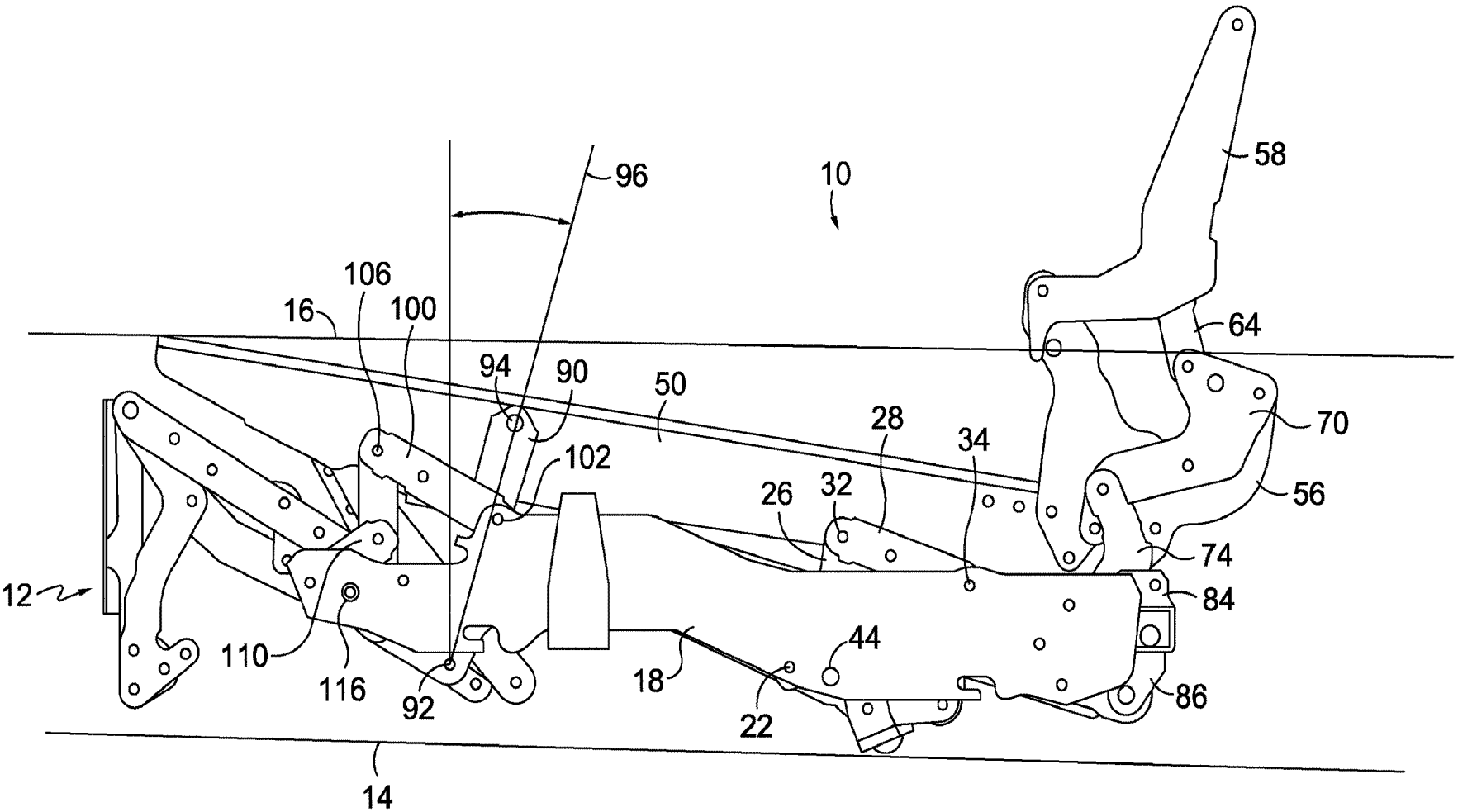
FIG. 2 is a side view of the recliner mechanism of FIG. 1, in accordance with aspects hereof.

FIGS. 1-8 illustrate a powered, recliner mechanism 10, shown with a long-back design. With initial reference to FIGS. 1 and 2, the recliner mechanism 10 is made to be placed on a powered recliner that includes a pair of arms supported by legs on a seating supporting surface. The recliner mechanism 10 is made to support a seat and a back as known to those of skill in the art. One or more ottomans (e.g., a foot support ottoman, a leg support ottoman, a footrest etc.) may also be coupled to the recliner mechanism 10 by a footrest linkage assembly 12 (as best seen in FIG. 2). As seen in FIG. 2, the recliner mechanism 10 offers a slim profile design, fitting between reference lines 14 and 16. This slim profile design offers the capability to utilize the recliner mechanism 10 on a high-leg, wood-to-the-floor chair design. The recliner mechanism 10 is supported on the chair arms by a stationary base plate 18 that is fixedly coupled to the adjacent chair arm. The base plate 18 supports the remainder of the recliner mechanism 10 between the chair arms.

Figure 3:
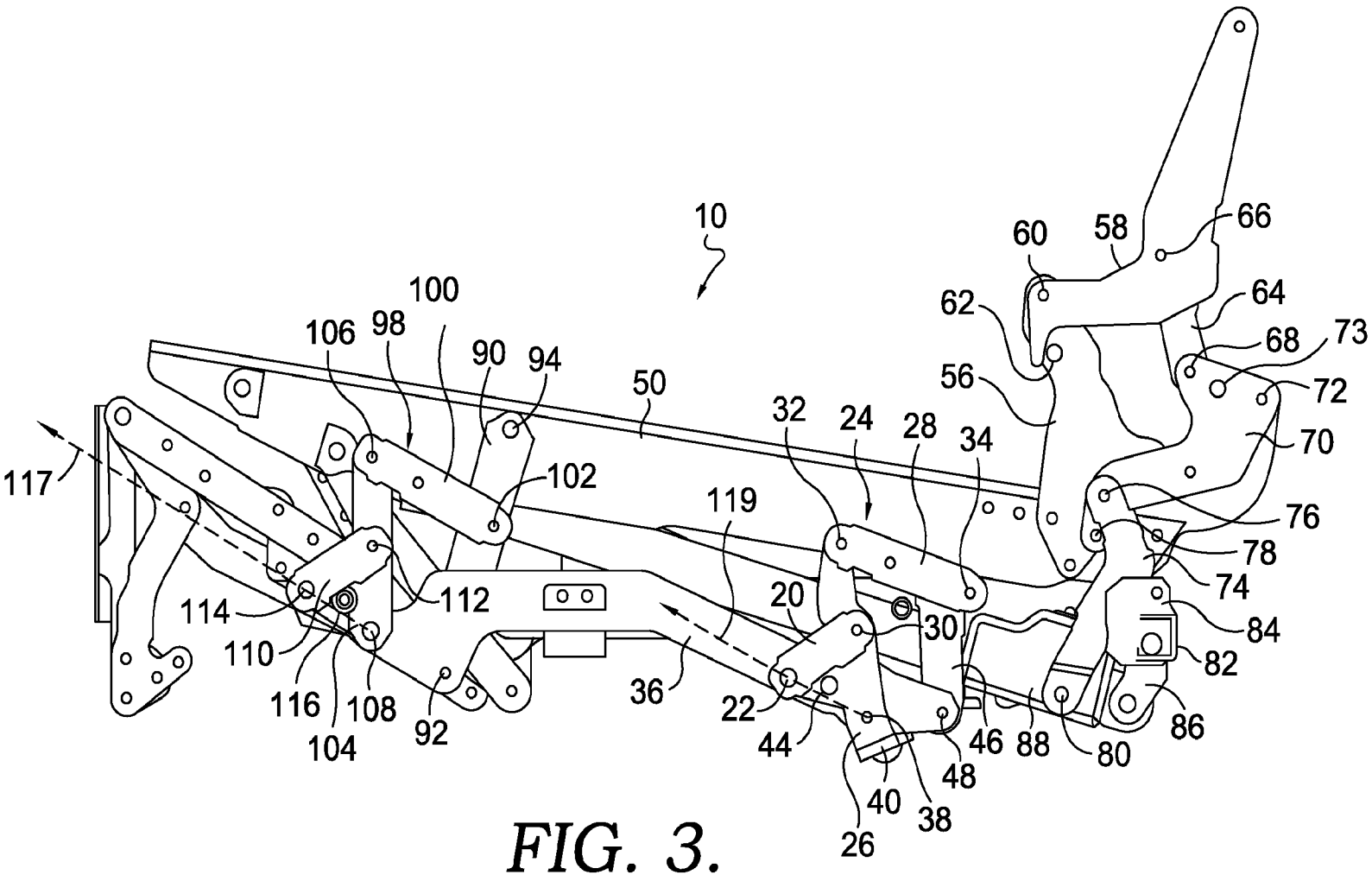
FIG. 3 is a view similar to FIG. 2, but with selected parts hidden to reveal other parts, in accordance with aspects hereof.

Near the rear of the base plate 18, as seen by comparing FIG. 2 to FIG. 3, a pivot control link 20 is pivotally coupled to the base plate 18 at pivot point 22. The pivot control link 20 is one of the links in a rear sub-linkage 24 that helps control movement of the seat and back as they move from a TV position to a fully reclined position. In some aspects, the rear sub-linkage 24 replaces a track-and-roller system. The rear sub-linkage 24 also has a rear travel link 26 and a rear toggle link 28. The pivot control link 20 is pivotally coupled near the center of the rear travel link 26 at pivot point 30. One end of the rear travel link 26 is pivotally coupled to the rear toggle link 28 at pivot point 32. The opposite end of the rear toggle link 28 is pivotally coupled to the base plate 18 at pivot point 34. The rear travel link 26 extends away from pivot point 32, and is pivotally coupled on the other end to a trolley link 36 at pivot point 38. Below pivot point 38, the rear travel link 26 may have an inwardly extending flange 40 that is used to fixedly couple a cross tube 42 from one rear travel link 26 to the other. As best seen in FIG. 3, the base plate 18 may have a stop 44 extending therefrom that abuts a portion of the pivot control link 20 when in the closed and TV positions. In some aspects, the distance from pivot point 22 to pivot point 30 on pivot control link 20 is the same as the distance from pivot point 30 to pivot point 38 on the rear travel link 26.

As seen in FIGS. 1 and 3, the rear end of the trolley link 36 is pivotally coupled to a rear pivot link 46 at pivot point 48. The rear pivot link 46 extends away from pivot point 48, and is pivotally coupled on the other end to a seat rail 50 at pivot point 52. As best seen in FIG. 1, pivot point 52 is rearward of pivot point 48 when in the closed position, such that a line 54 drawn between pivot point 52 and pivot point 48 angles rearwardly. This geometry, along with other geometry described below, allows the compact, shorter links (allowing a slim design usable on a high-leg, wood-to-the-floor mechanism) to achieve the desired seat movement as the recliner mechanism moves from the closed position to the TV position.

As seen in FIG. 3, a rear seat bracket 56 is fixedly coupled to the seat rail 50. The rear seat bracket 56 is pivotally coupled to a back bracket 58 at pivot point 60. In some aspects, the rear seat bracket 56 has a stop 62 that abuts a portion of the back bracket 58 in the closed and TV positions. The back bracket 58 may be configured as a "KD bracket" allowing the back bracket 58 to be easily coupled to a back of the recliner. A back support link 64 is pivotally coupled to the back bracket 58 at pivot point 66. The other end of the back support link 64 is pivotally coupled to a back toggle 70 at pivot point 68. Near pivot point 68, the back toggle 70 is also pivotally coupled to the rear seat bracket 56 at pivot point 72. In some aspects, the back toggle 70 may have a stop 73 extending inwardly therefrom that abuts a portion of the rear seat bracket 56 when in the fully reclined position of FIGS. 6-8. The lower end of the back toggle 70 is pivotally coupled to a lower toggle 74 at pivot point 76. In some aspects, the back toggle 70 has a stop 78 that abuts a portion of the lower toggle 74 when in the closed position. The end of the lower toggle 74 opposite pivot point 76 is pivotally coupled to the base plate 18 at pivot point 80.

At the rear of the base plate 18, as seen in FIGS. 1 and 2, a rear motor tube 82 is coupled between opposing base plates 18 via a motor bracket 84 fixedly coupled to the base plate 18. Generally mid-way along the rear motor tube 82, a clevis 86 is used to pivotally couple a motor or actuator 88 to the rear motor tube 82. The extending shaft of the motor 88 is coupled to a link on the footrest assembly 12, as is further described below.

As best seen in FIG. 3, a front pivot link 90 is pivotally coupled to the trolley link 36 at pivot point 92. The front pivot link 90 extends away from pivot point 92, and is pivotally coupled on its opposite end to the seat rail 50 at pivot point 94. As seen in FIG. 2, a reference line 96 drawn between pivot point 92 and pivot point 94 is oriented rearwardly from vertical when in the closed position, similar to reference line 54 discussed above with reference to rear pivot link 46. This orientation allows the sear rail 50 to achieve the desired forward movement when going from the closed position to the TV position while still providing a shorter front pivot link 90 (allowing for the various styling options discussed above).

With continued reference to FIG. 3, a front sub-linkage 98 is used that is similar in many ways to the rear sub-linkage 24 described above. The front sub-linkage 98 includes a toggle link 100 that is pivotally coupled on one end to the base plate 18 at pivot point 102. The other end of the toggle link 100 is pivotally coupled to a front travel link 104 at pivot point 106. The end of the front travel link 104 opposite pivot point 106 is pivotally coupled to the trolley link 36 at pivot point 108. Generally mid-way between pivot point 106 and pivot point 108, the front travel link 104 is pivotally coupled to a pivot control link 110 at pivot point 112. The end of the pivot control link 110 opposite pivot point 112 is pivotally coupled to the base plate 18 at pivot point 114. In some aspects, a stop 116 is fixedly coupled to the base plate 18, extending inwardly therefrom, and abutting a portion of the pivot control link 110 when the recliner mechanism 10 is in the closed position or the TV position. In some aspects, the distance from pivot point 114 to pivot point 112 on pivot control link 110 is the same as the distance from pivot point 112 to pivot point 108 on the front travel link 104. This geometry on the front sub-linkage 98, along with the geometry on the rear sub-linkage 24 controls the movement of the seat rail 50 in a straight line as the mechanism moves from the TV position to the fully-reclined position. Moreover, as indicated by reference front line of travel 117 in FIG. 3, the pivot point 108 moves on a line extending through pivot point 114 as the mechanism moves from the TV position to the fully-reclined position. Similarly, as indicated by reference rear line of travel 119 in FIG. 3, the pivot point 38 moves on a line extending through pivot point 22 as the mechanism moves from the TV position to the fully-reclined position. In some aspects, the front line of travel 117 is not parallel to the rear line of travel 119, which may additionally change the pitch of the seat rail 50.

Figure 5:
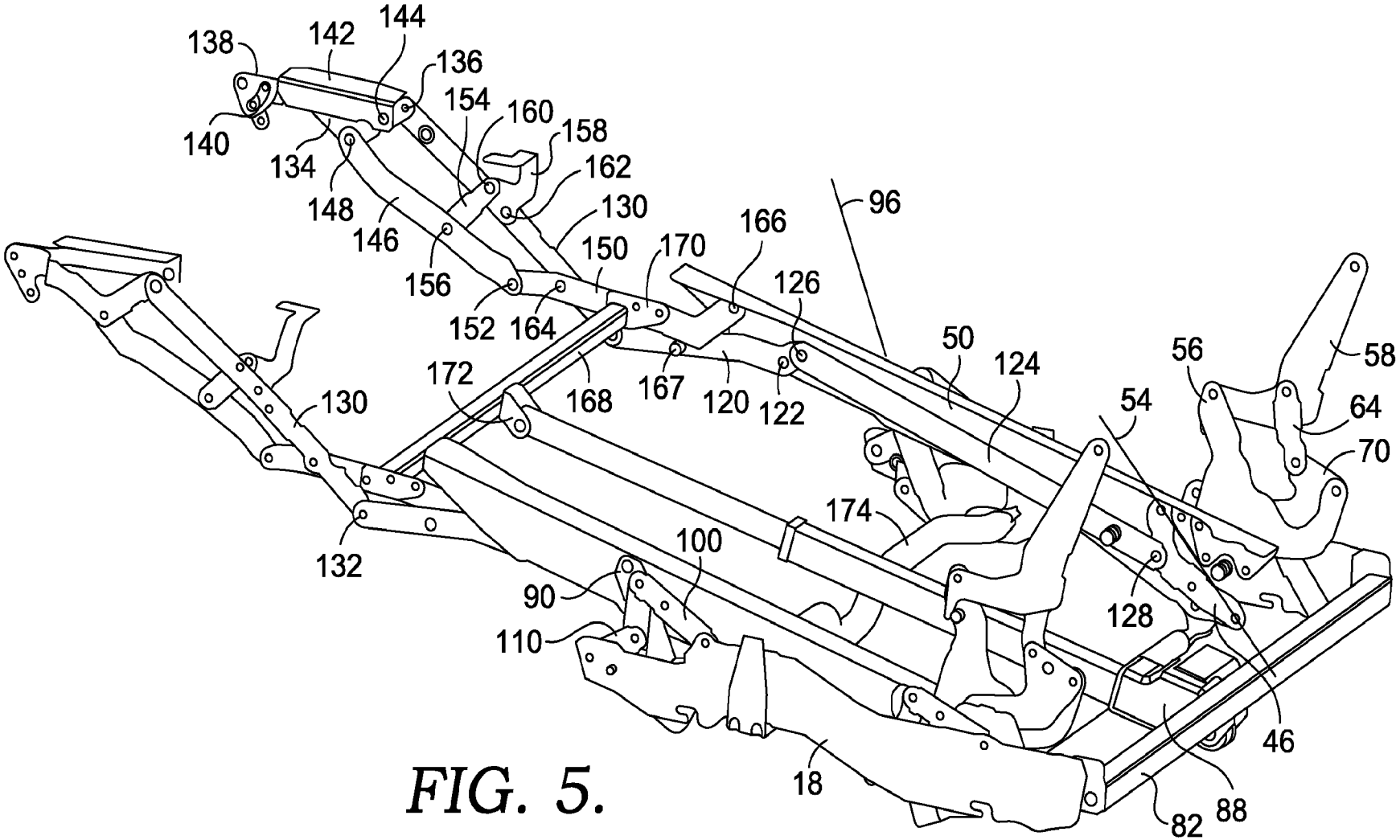
FIG. 5 is a perspective view of the mechanism of FIG. 4 in the TV position, in accordance with aspects hereof.
Figure 6:
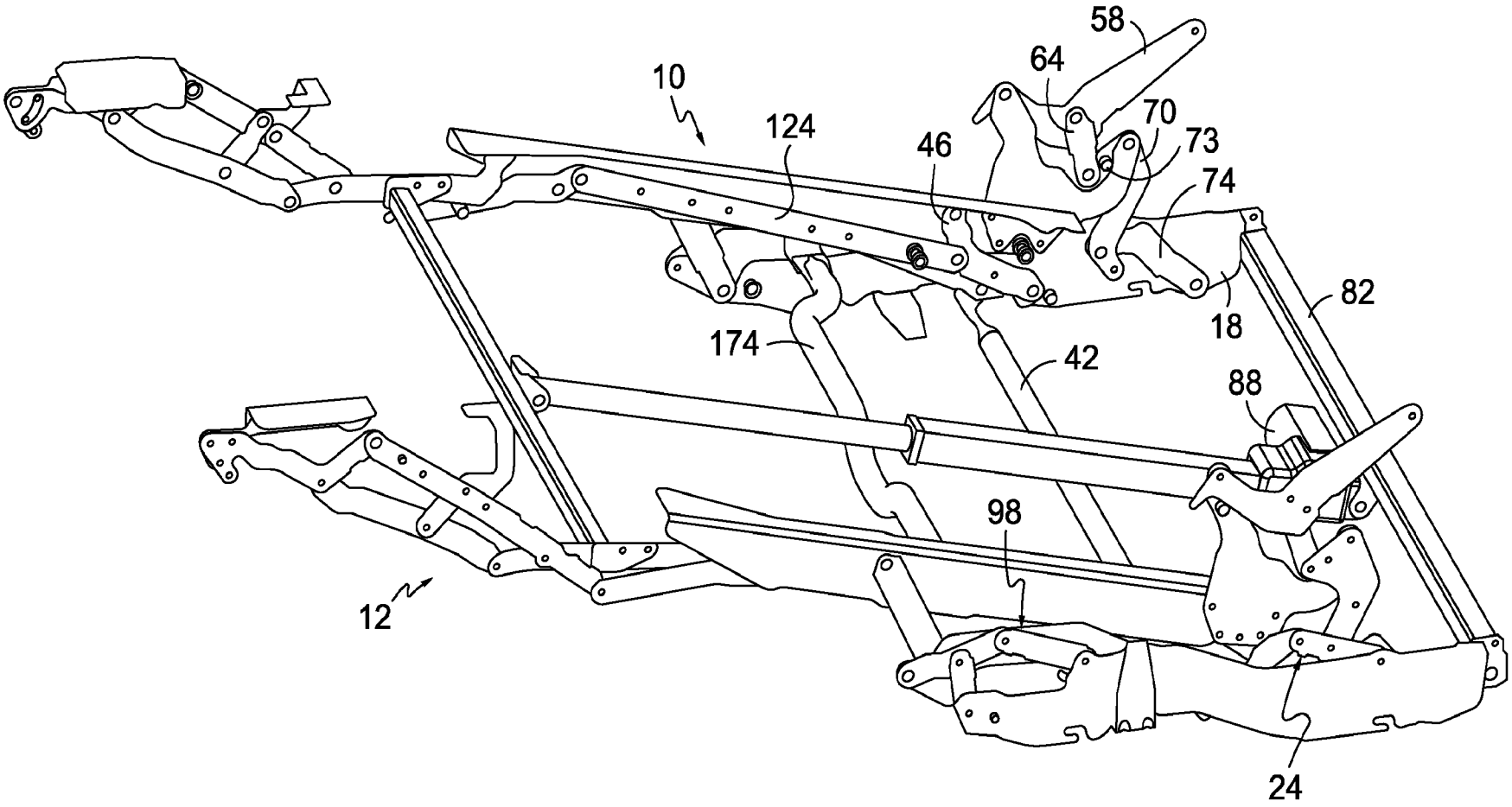
FIG. 6 is a perspective view of the reclining mechanism of FIG. 4, but in a fully reclined position, in accordance with aspects hereof.
Figure 7:
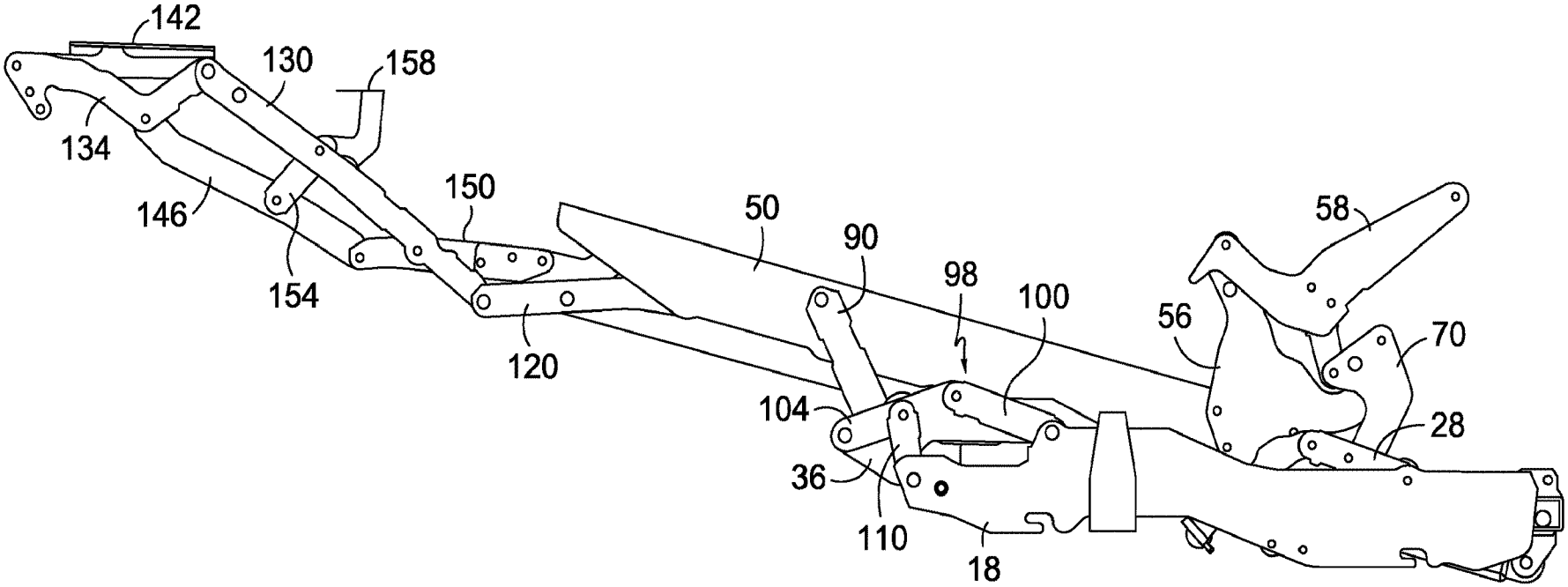
FIG. 7 is a side view of the reclining mechanism of FIG. 6 in the fully reclined position, in accordance with aspects hereof.
Figure 8:
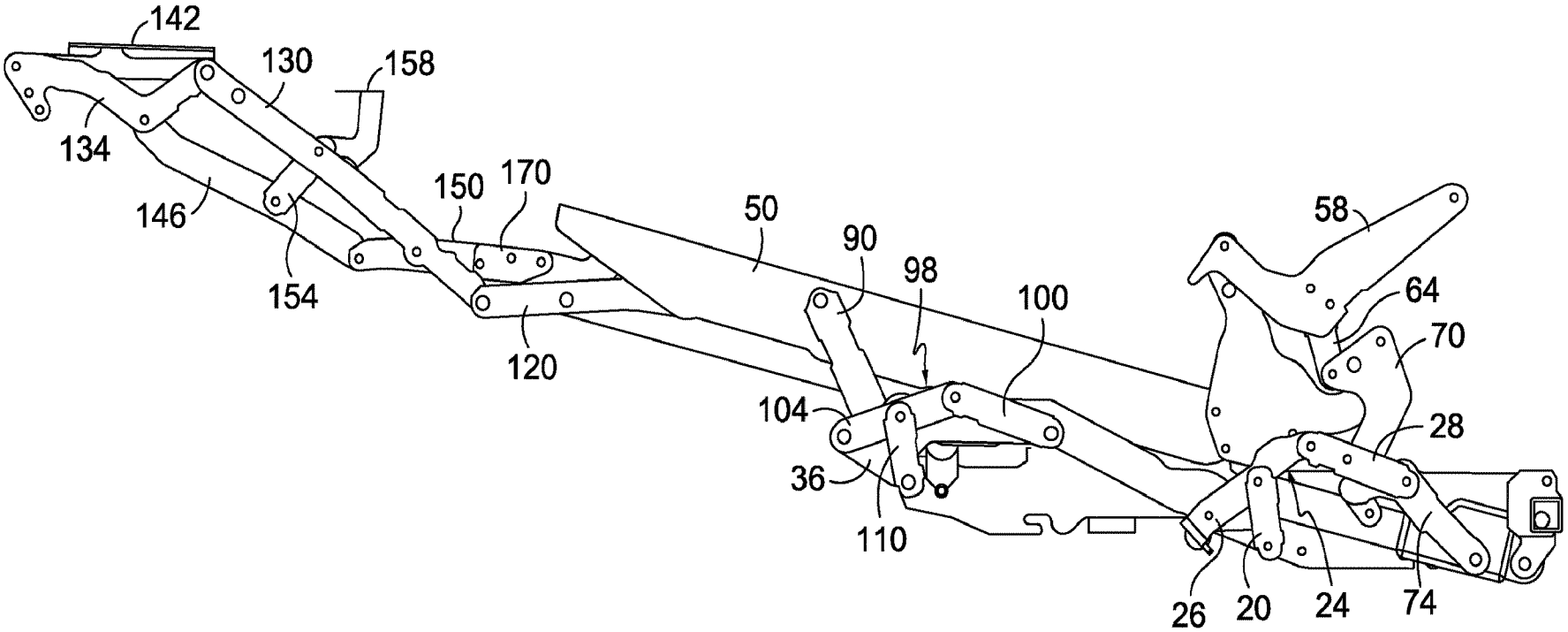
FIG. 8 is a side view similar to FIG. 7, but shown with certain parts hidden in the fully reclined position, in accordance with aspects hereof.
Figure 9:
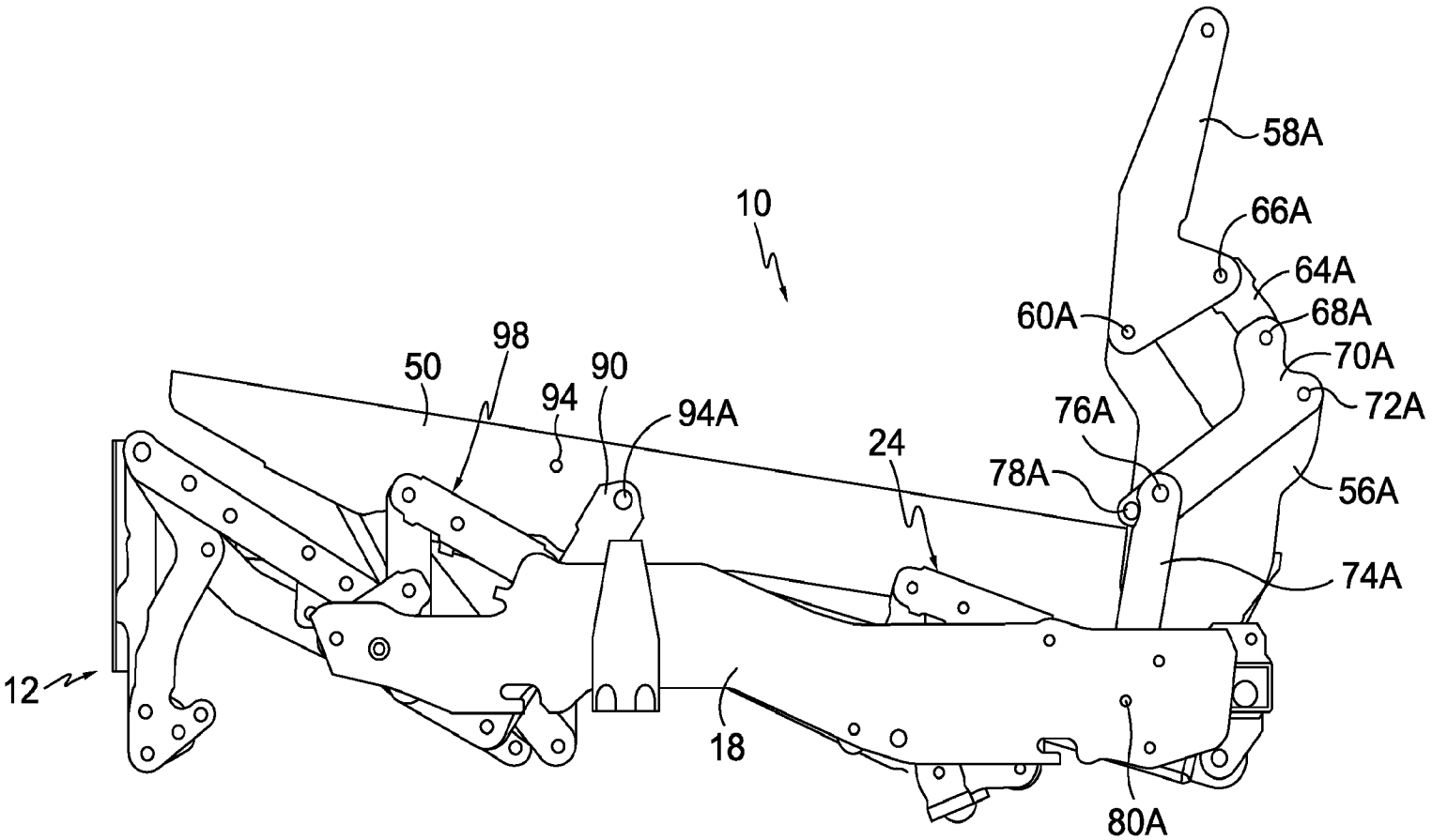
FIG. 9 is a side view of another aspect of a recliner mechanism, shown in the closed position, in accordance with aspects hereof.
Figure 10:
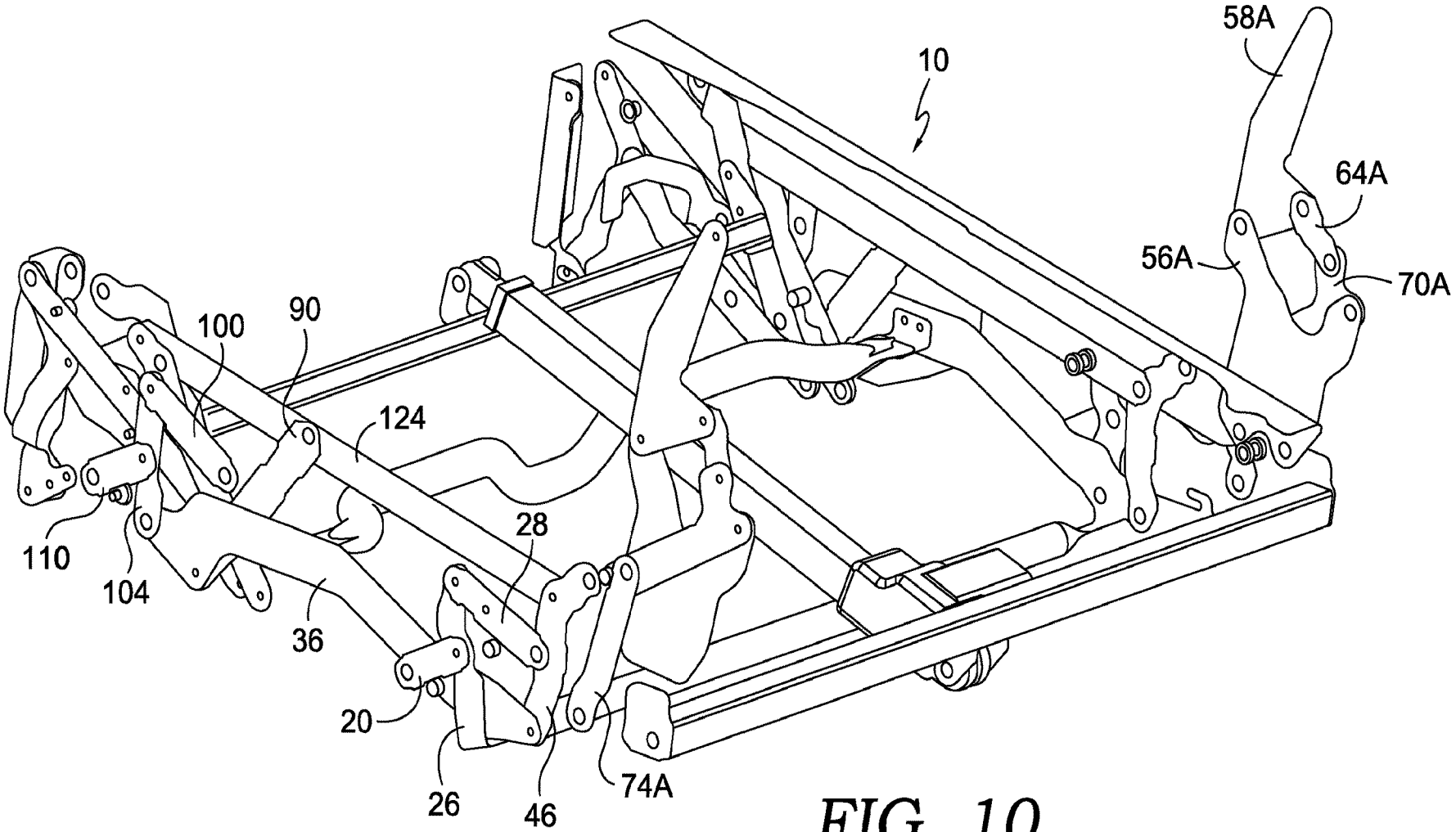
FIG. 10 is a perspective view of the mechanism of FIG. 9, but with the base plate hidden on one side to show other parts, in accordance with aspects hereof.

The footrest linkage assembly 12 is best seen in FIGS. 5 and 6, when the recliner mechanism 10 is in the TV position and the fully reclined position, respectively. The footrest linkage assembly 12 includes a rear ottoman link 120 that is pivotally coupled to the seat rail 50 at pivot point 122. Near pivot point 122, a footrest drive link 124 is pivotally coupled to the rear ottoman link 120 at pivot point 126. The opposite end of the footrest drive link 124 is pivotally coupled to the rear pivot link 46 at pivot point 128. The rear ottoman link 120 extends away from pivot point 122 and is pivotally coupled on the opposite end to a main ottoman link 130 at pivot point 132. The main ottoman link 130 extends away from pivot point 132 and is pivotally coupled on the opposite end to mounting link 134 at pivot point 136. The mounting link 134 supports a spring loaded ottoman. The end of the mounting link 134 opposite pivot point 136 is coupled to a bracket 138 at an arcuate slot 140, as best seen in FIG. 5. On the other end of the bracket 138, an ottoman mounting bracket 142 is pivotally coupled to the bracket 138 at pivot point 144. The mounting link 134 is also pivotally coupled to an inside ottoman link 146 at pivot point 148. The opposite end of the inside ottoman link 146 is pivotally coupled to a front ottoman link 150 at pivot point 152. Generally mid-way between pivot point 148 and pivot point 152, a control link 154 is pivotally coupled to the inside ottoman link 146 at pivot point 156. The other end of the control link 154 is pivotally coupled to a mid-ottoman bracket 158 at pivot point 160. Near pivot point 160, the mid-ottoman bracket 158 is also pivotally coupled to the main ottoman link 130 at pivot point 162. As best seen in FIG. 5, the main ottoman link 130 is also pivotally coupled to the front ottoman link 150 at pivot point 164. The front ottoman link 150 is pivotally coupled to the seat rail 50 at pivot point 166. As seen in FIG. 5, the rear ottoman link 120 may have a stop 167 extending therefrom that abuts the front ottoman link 150 when the footrest linkage assembly 12 is moved to the TV position or to the fully reclined position.

As seen in FIG. 5, a front motor tube 168 is fixedly coupled to and between opposing front ottoman links 150 via mounting brackets 170. Generally mid-way along the front motor tube 168, a clevis 172 is used to pivotally couple the extending shaft of the motor 88.

As best seen in FIG. 1, a support tube 174 may be fixedly mounted to and between opposing trolley links 36 to provide stability to the recliner mechanism 10.

Figure 4:
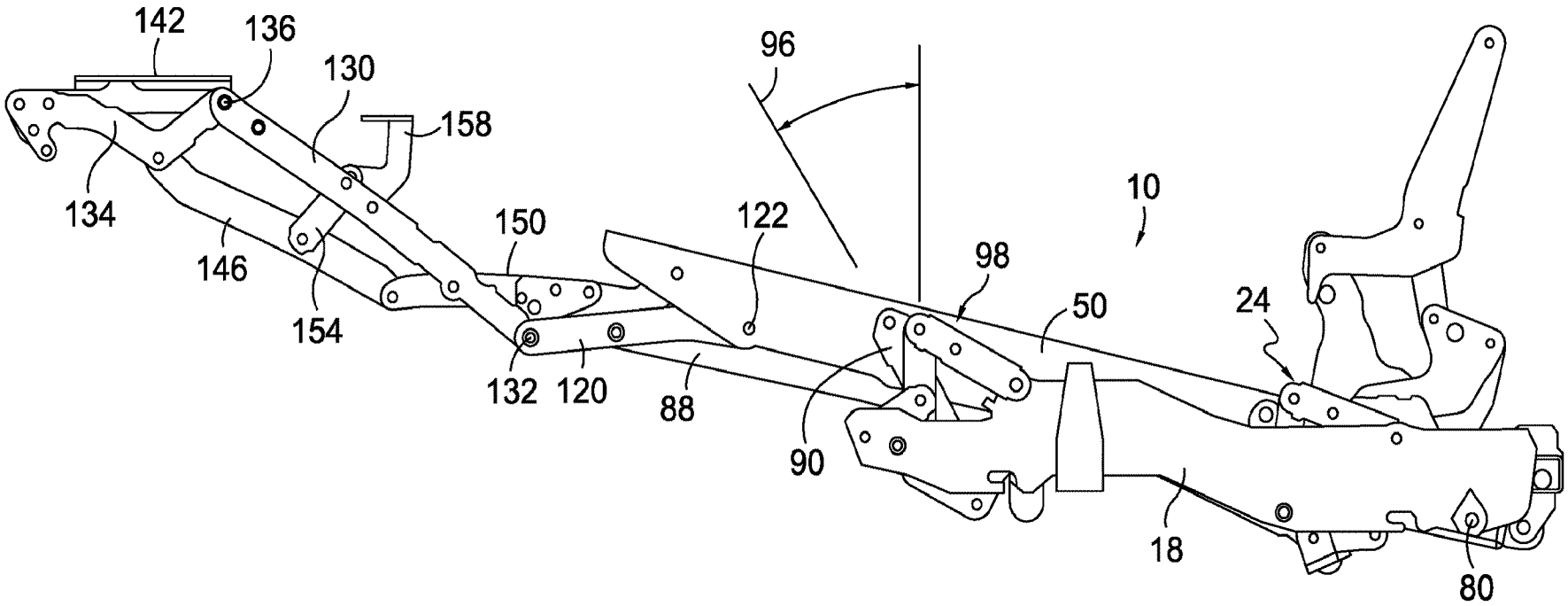
FIG. 4 is a side view of the mechanism of FIG. 2, but shown in the TV position, in accordance with aspects hereof.

When moving from the closed position of FIGS. 1-3 to the TV position of FIGS. 4-5, the motor 88 is activated to extend the shaft, thus moving the recliner mechanism 10 from the closed position to the TV position. The front pivot link 90 and the rear pivot link 46 move from a rearward inclination angle (as shown by reference line 54 of FIG. 1 and reference line 96 of FIG. 2) to a forward inclination angle (as shown by reference line 54 in FIG. 5 and reference line 96 of FIG. 4). This provides forward movement in the seat rail 50 and allows the recliner in which the recliner mechanism 10 is used to be designed as a "wall proximity" chair, where the back of the recliner can be placed relatively close to a wall. In addition, by orienting the front pivot link 90 and the rear pivot link 46 in a rearward inclination in the closed position, a desired amount of forward travel of the seat rail 50 is achievable while still having a slim profile, allowing for the recliner to be styled as a "high-leg" chair, with a wood-to-the-floor design. To move the recliner mechanism 10 from the TV position of FIGS. 4-5 to the fully reclined position of FIGS. 6-8, the motor 88 is again activated to further extend the motor shaft. This results in further movement of the seat rail 50 due to the front sub-linkage 98 and the rear sub-linkage 24, and the trolley link 36 as can be seen by comparing the links in FIG. 4 with the links in FIG. 8. In the fully reclined position, the back bracket 58 (and thus the back of the recliner) is reclined as well, and is moved forwardly. Again this motion is achieved with a slim-profile design.

Figure 11:
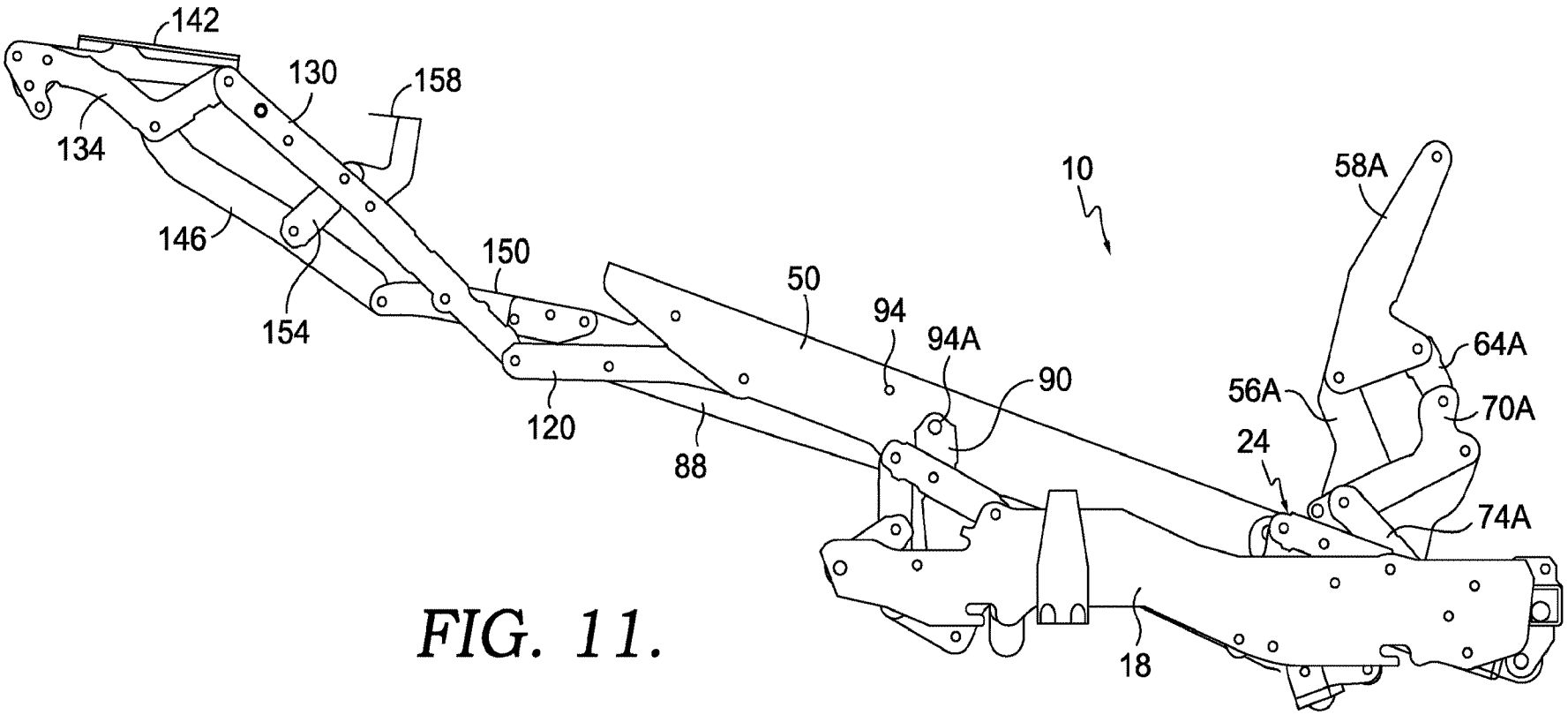
FIG. 11 is a side view of the mechanism of FIG. 9, shown in the TV position, in accordance with aspects hereof.
Figure 12:
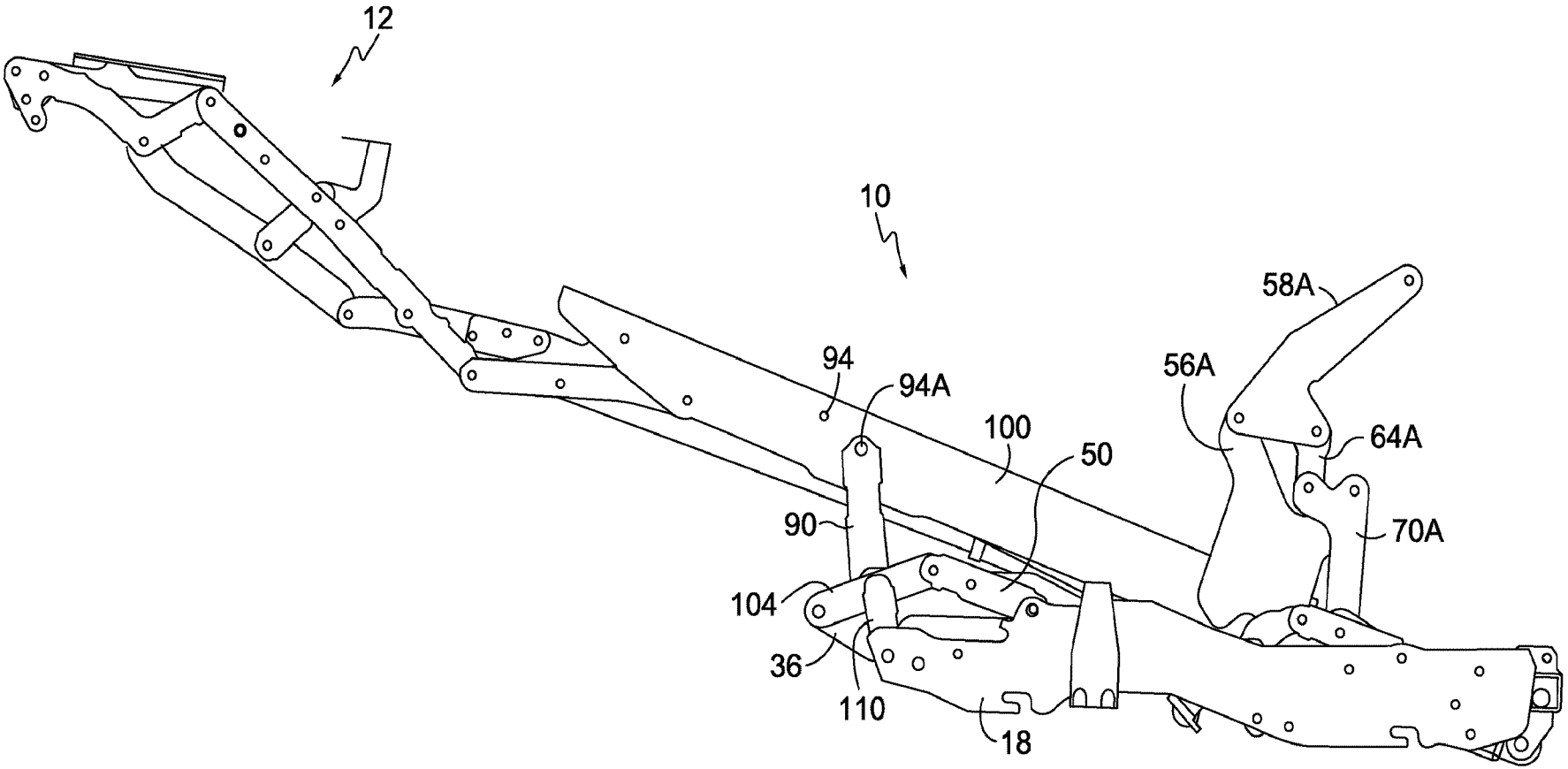
FIG. 12 is a side view of the recliner mechanism of FIG. 9 in the fully reclined position, in accordance with aspects hereof.
Figure 13:
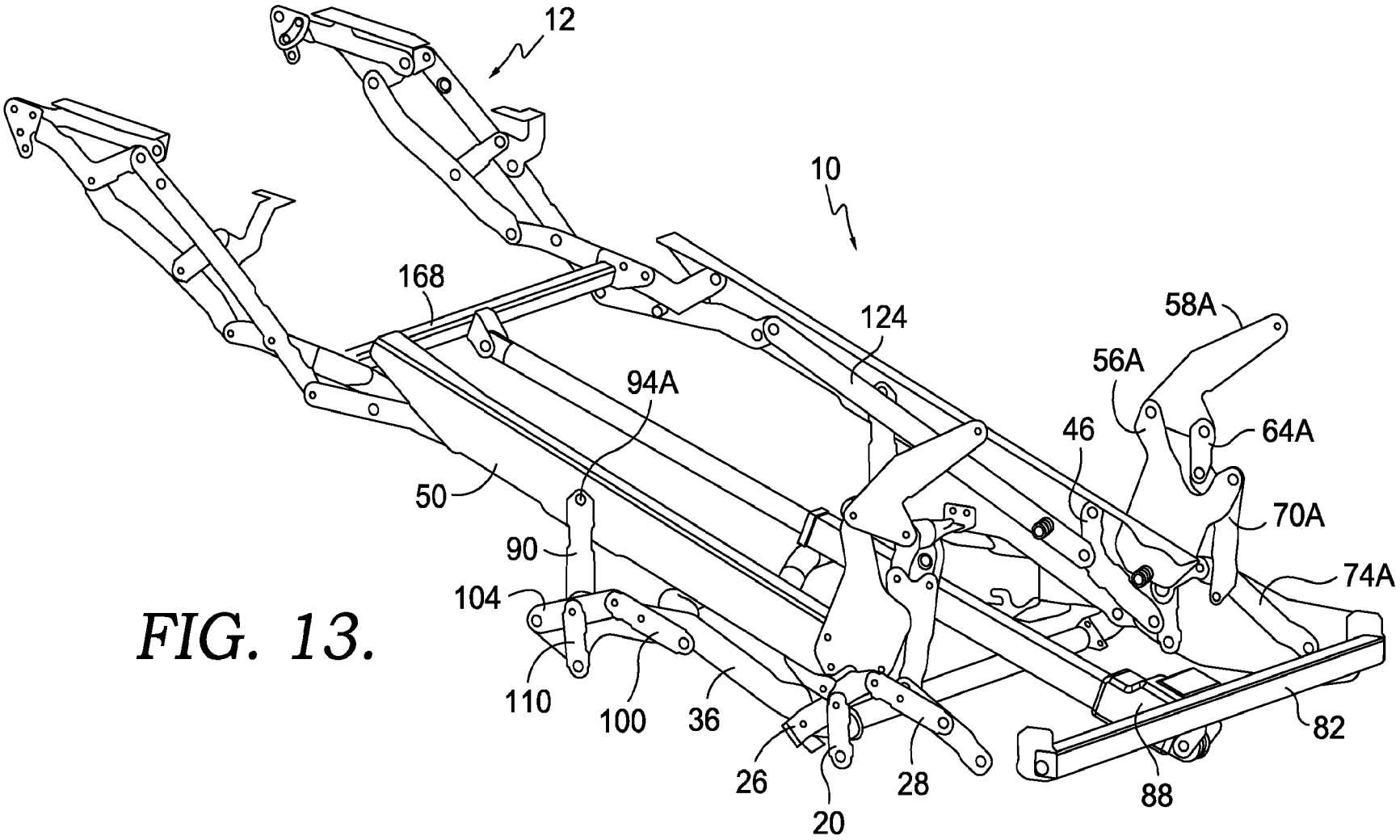
FIG. 13 is a view similar to FIG. 12 but with the side plate hidden to show other details of construction, in accordance with aspects hereof.

Another aspect of the recliner mechanism 10 is shown in FIGS. 9-13. One difference from the aspect shown in FIGS. 1-8 is the placement of the front pivot link 90 on seat rail 50. As best seen in FIG. 11, the front pivot link 90 is pivotally coupled to a new location on seat rail 50, shown in FIG. 11 as pivot point 94A. For reference, the pivot point 94 used in the aspect of FIGS. 1-8 is also shown in FIG. 11, although not used in this aspect. By providing seat rail 50 with both possible pivot points 94 and 94A, the movement of the seat rail 50 as it moves from the closed position to the TV and fully reclined positions can be altered as desired. With the alternate pivot point 94A being used, the pitch of the seat is increased (as compared to the aspect shown in FIGS. 1-8). This has been found to be desirable by some users, offering more of a "zero-gravity" feel to the TV position and the fully reclined position.

Additionally, the aspect shown in FIGS. 9-13 utilizes an optional "short back" design. Note that the same back configuration shown in FIGS. 1-8 could be used with the pivot point 94A, without changing to the short back configuration shown in FIGS. 9-13. As shown, in FIG. 9, the short back option utilizes a modified back bracket 58A. The back bracket 58A is pivotally coupled to a modified rear seat bracket 56A at pivot point 60A and to a modified back support link 64A at pivot point 66A. The modified rear seat bracket 56A is fixedly coupled to the seat rail 50. The modified back support link 64A is pivotally coupled on the other end to a modified back toggle 70A at pivot point 68A. The modified back toggle 70A is also pivotally coupled to the modified rear seat bracket 56A at pivot point 72A. The lower end of the modified back toggle 70A is pivotally coupled to a modified lower toggle 74A at pivot point 76A. In some aspects, the modified back toggle 70A has a stop 78A near pivot point 76A that may abut a portion of the modified lower toggle 74A when in the closed position. The lower end of the modified lower toggle 74A is pivotally coupled to the base plate 18 at pivot point 80A. The use of the short back design of FIGS. 9-13 allows a design utilizing a "frame-within-a frame" recliner, where the top of the back of the recliner stays more within a vertical frame at the back of the recliner, which has been found desirable by some manufacturers and consumers. The remainder of the recliner mechanism has the same links and configuration as that described above with respect to FIGS. 1-8, and so will not be repeated here.

Figure 14:
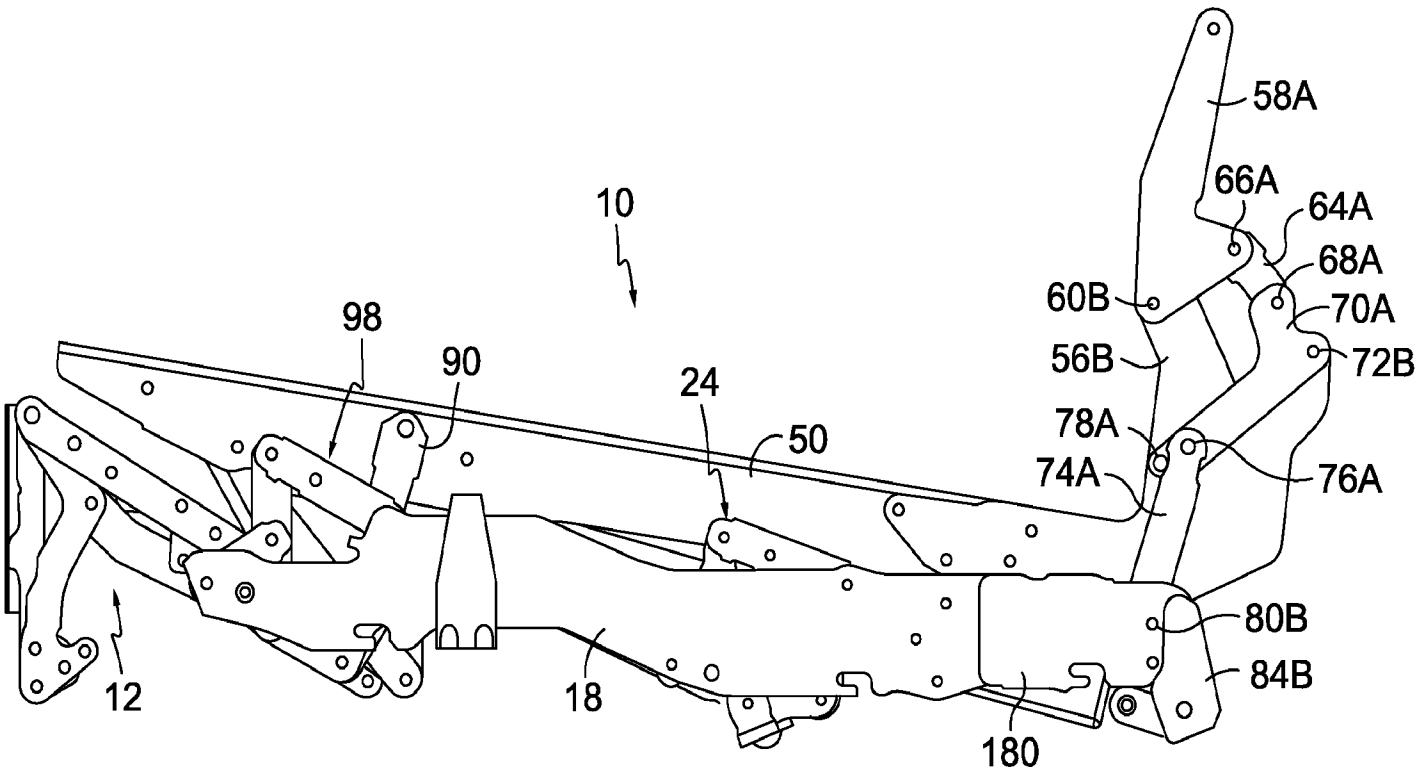
FIG. 14 is a side view of another aspect of a recliner mechanism in the closed position, in accordance with aspects hereof.
Figure 15:
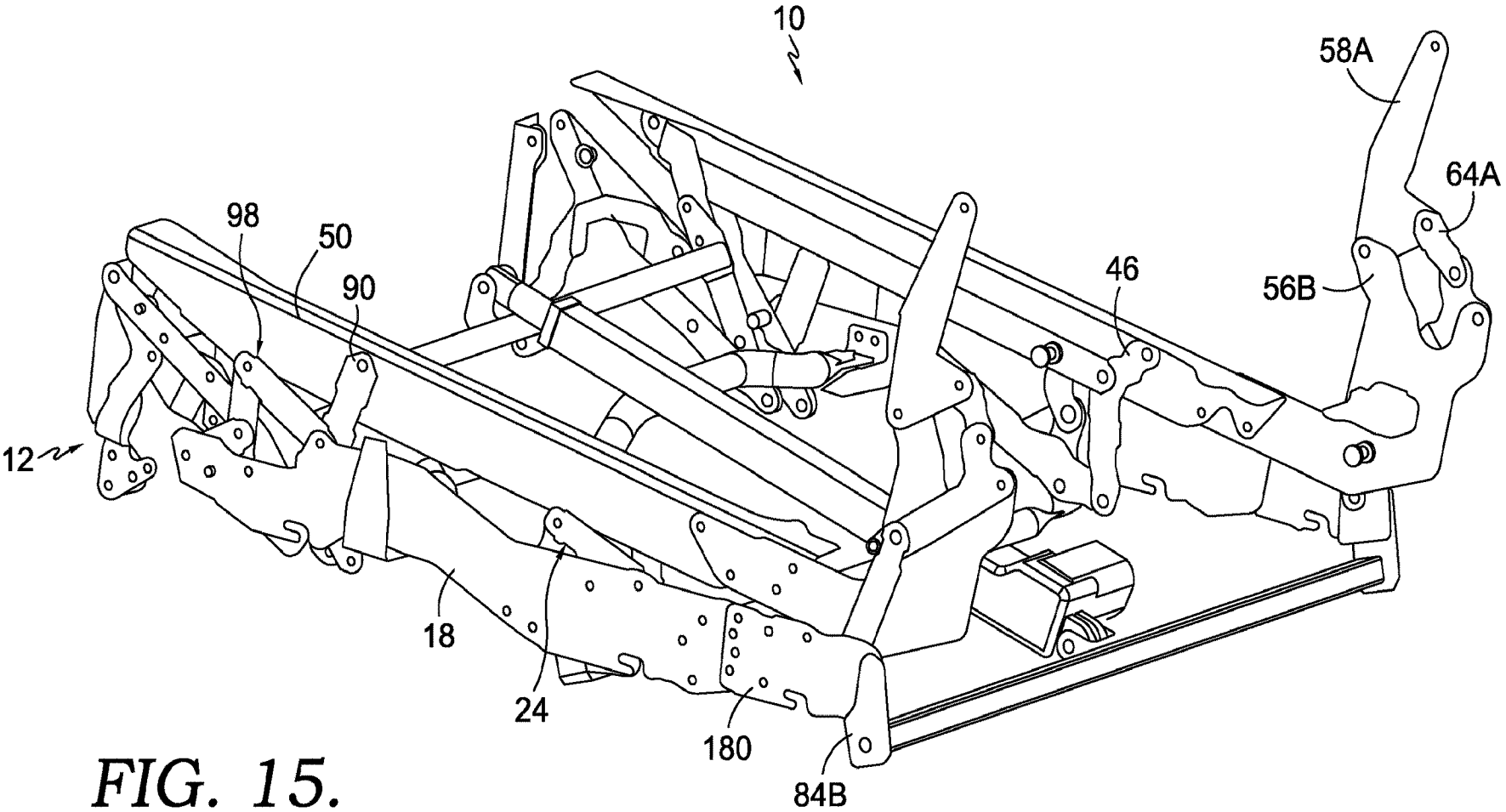
FIG. 15 is a perspective view of the mechanism of FIG. 14, in accordance with aspects hereof.
Figure 16:
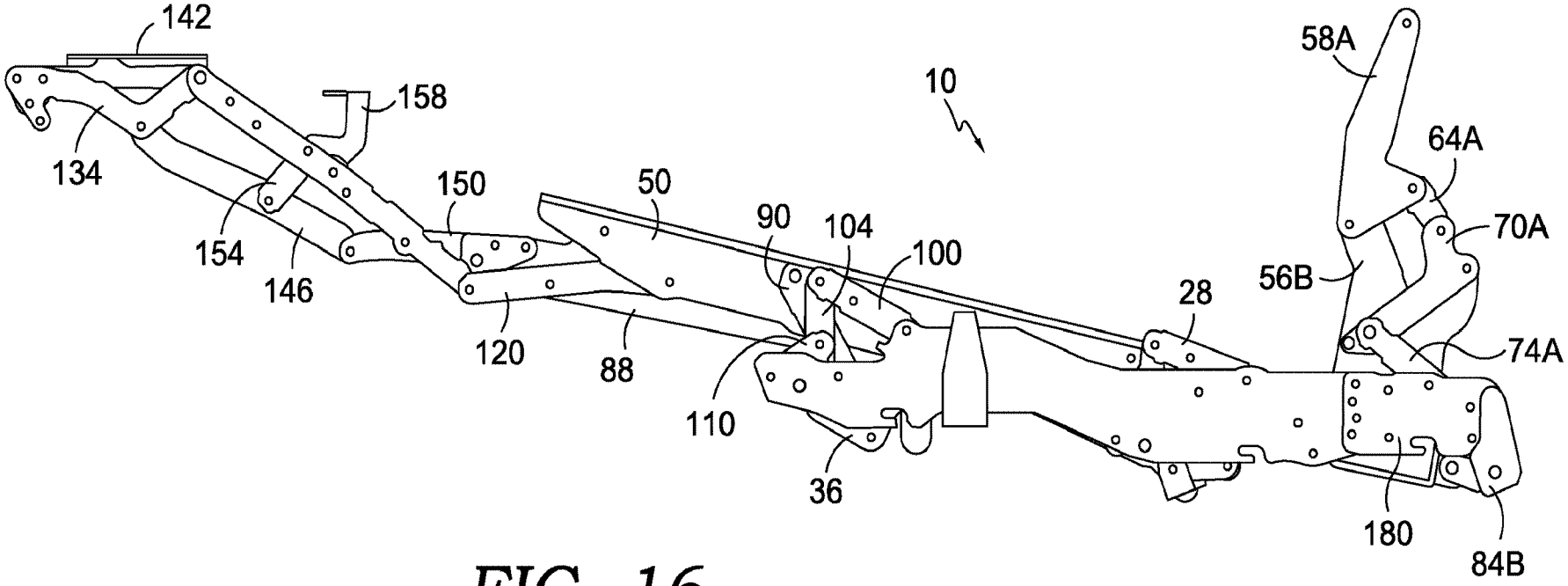
FIG. 16 is a side view of the recliner mechanism of FIG. 14, in the TV position, in accordance with aspects hereof.
Figure 17:
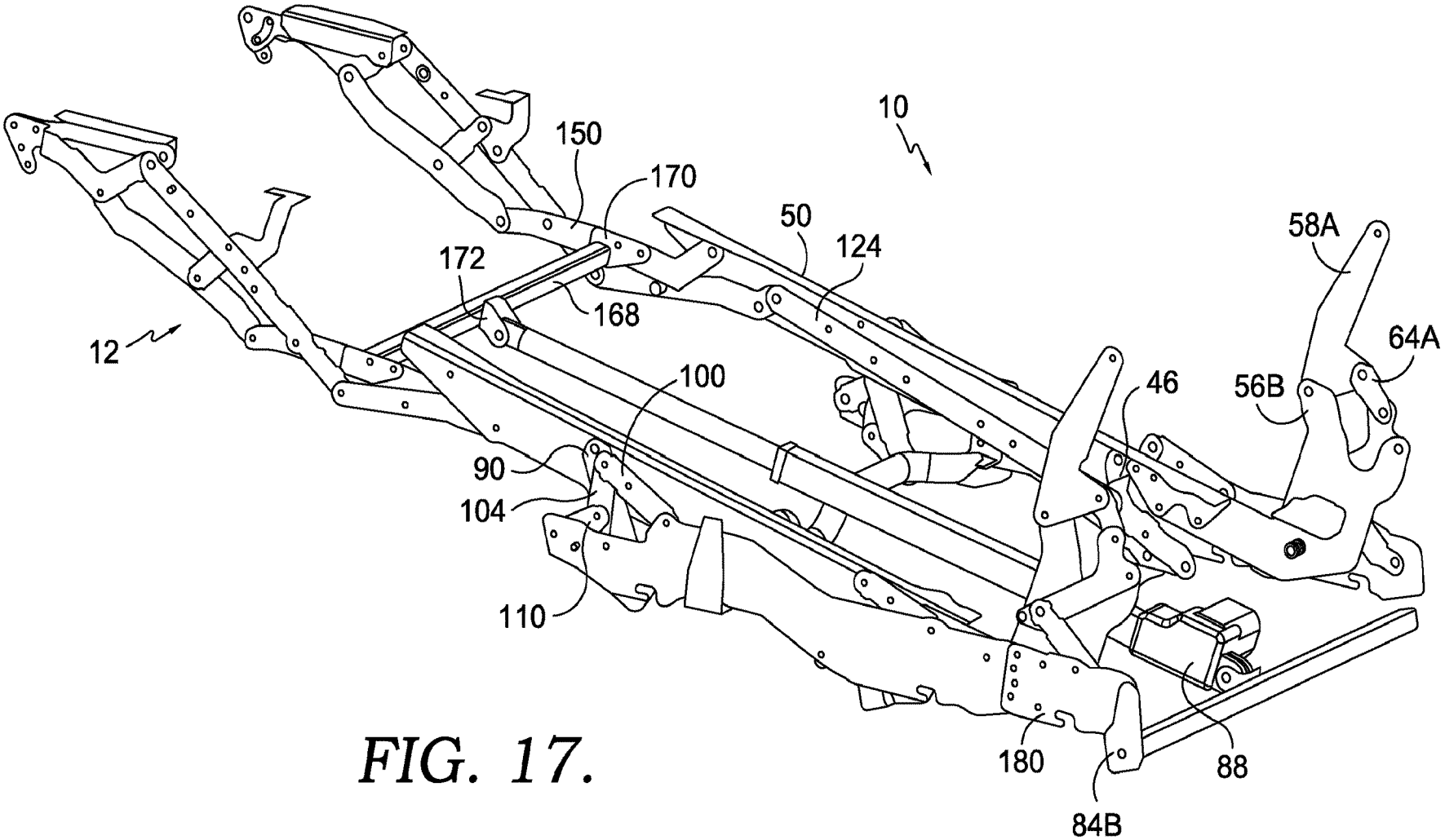
FIG. 17 is a perspective view of the mechanism of FIG. 16, in accordance with aspects hereof.
Figure 18:
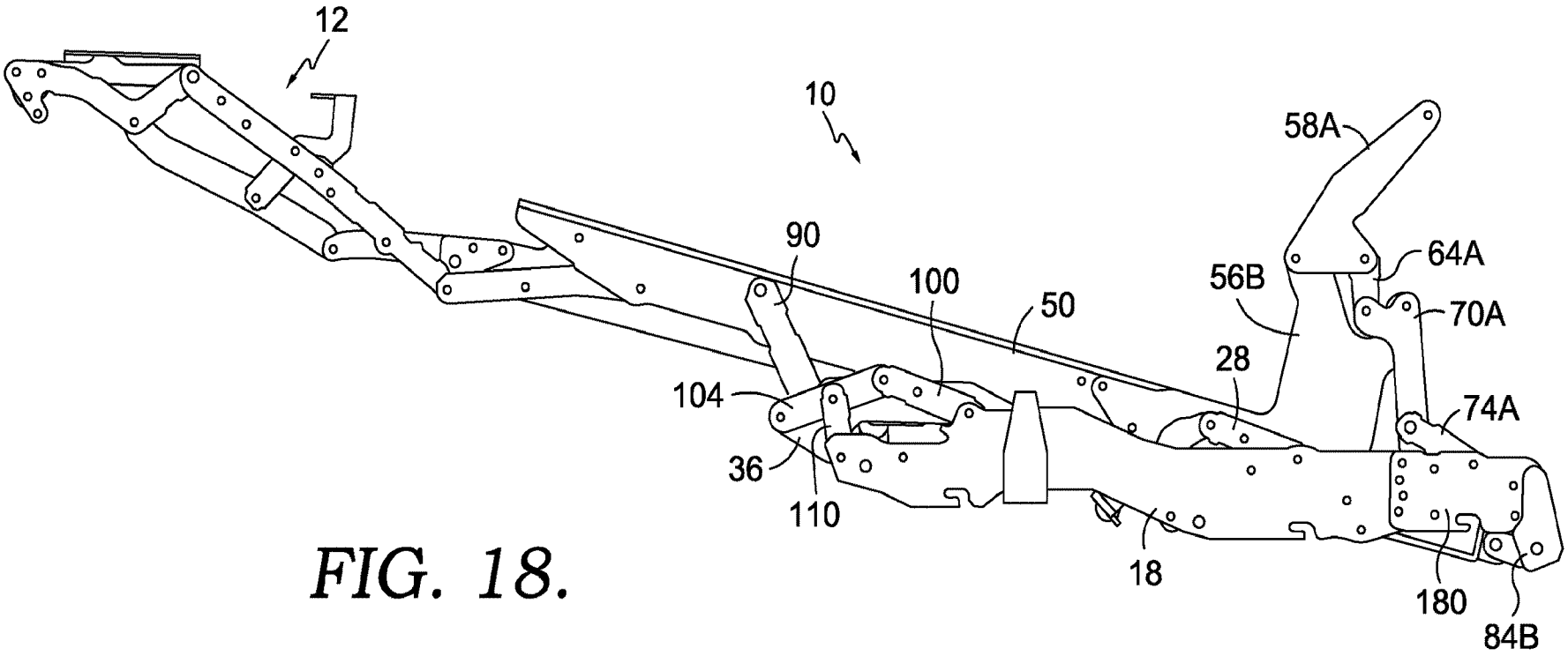
FIG. 18 is a side view of the mechanism of FIG. 14, in the fully reclined position, in accordance with aspects hereof.

Yet another aspect of the recliner mechanism 10 is shown in FIGS. 14-19. In this aspect, a "deep seat" option is utilized, as desired by some manufacturers and consumers. The deep seat option allows for a seat with added depth from the back to the front. In some aspects, this option might be used on recliners having an upholstered back that extends down to, and sits on top of, the upholstered seat. In this aspect, a modified rear seat bracket 56B is used and is fixedly coupled to the seat rail 50. As seen in FIG. 14, the modified rear seat bracket 56B extends rearwardly beyond that of rear seat bracket 56 of FIGS. 1-8 or modified rear seat bracket 56A of FIGS. 9-13. The majority of the back linkage is similar to that described above with respect to FIGS. 9-13. For completeness, as shown, in FIG. 14, the modified back bracket 58A is pivotally coupled to the modified rear seat bracket 56B at pivot point 60B and to the modified back support link 64A at pivot point 66A. The modified back support link 64A is pivotally coupled on the other end to the modified back toggle 70A at pivot point 68A. The modified back toggle 70A is also pivotally coupled to the modified rear seat bracket 56B at pivot point 72B. The lower end of the modified back toggle 70A is pivotally coupled to the modified lower toggle 74A at pivot point 76A. In some aspects, the modified back toggle 70A has the stop 78A near pivot point 76A that abuts a portion of the modified lower toggle 74A when in the closed position. The lower end of the modified lower toggle 74A is pivotally coupled to a base plate extension 180 (which is fixedly coupled to the base plate 18) at pivot point 80B. A modified motor bracket 84B is fixedly coupled to the base plate extension 180, and the rear motor tube 82 is coupled to the modified motor bracket 84B. The remainder of the recliner mechanism has the same links and configuration as that described above with respect to FIGS. 1-8, and so will not be repeated here.

Figure 19:
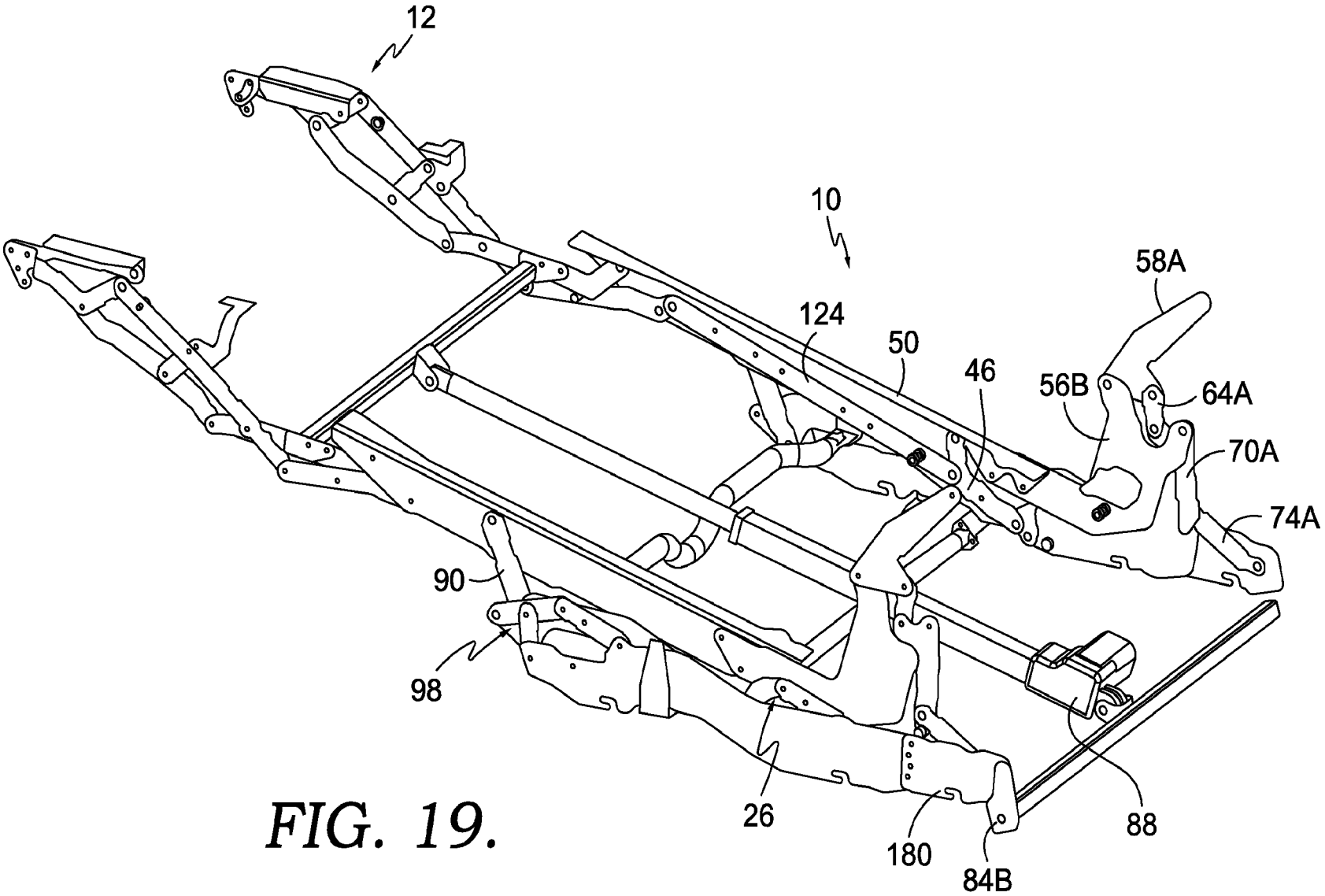
FIG. 19 is a perspective view of the mechanism of FIG. 18, in accordance with aspects hereof.
Figure 19A:
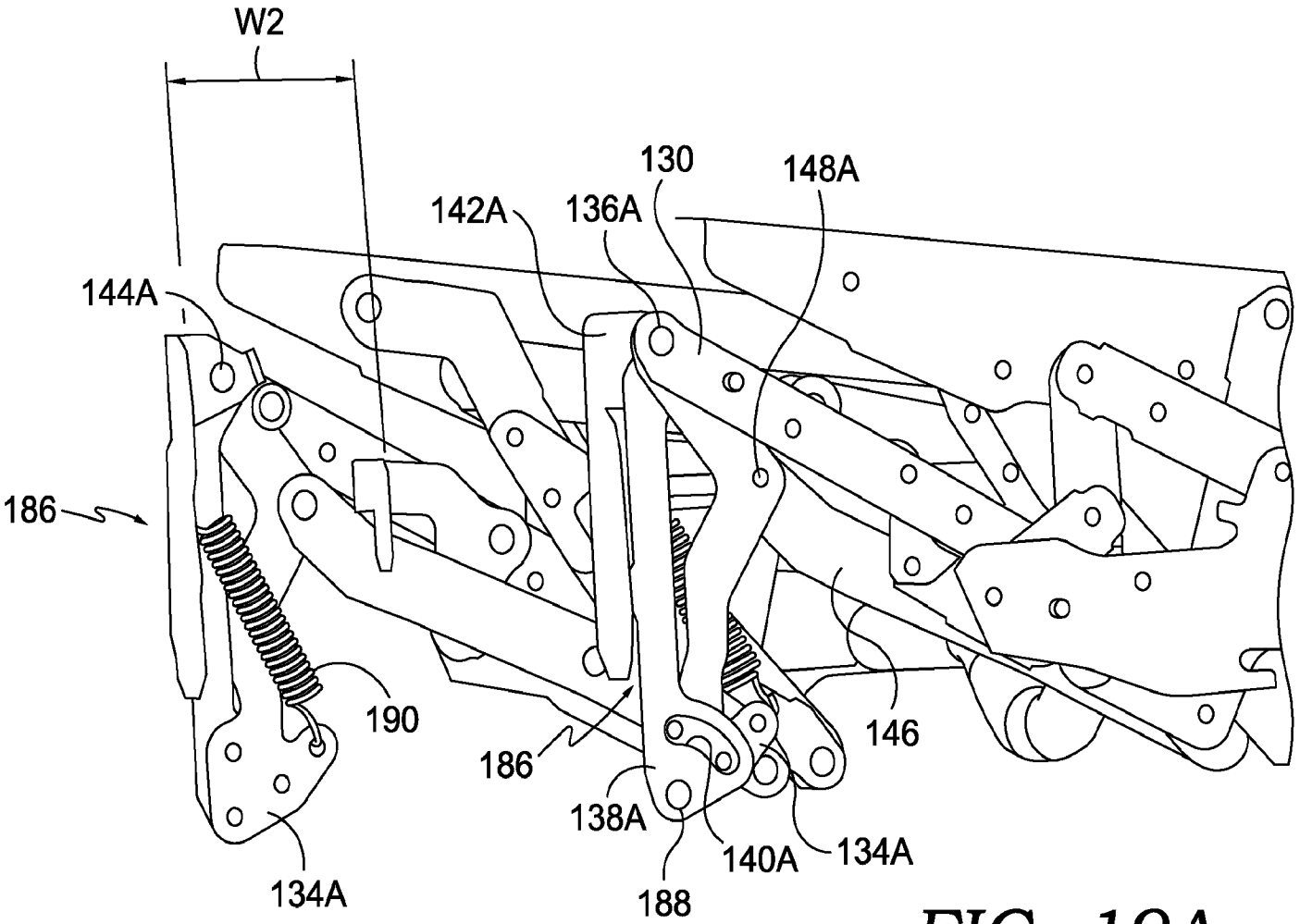
FIG. 19A is an enlarged view of a modified spring loaded ottoman in the closed position, in accordance with aspects hereof.

A modified spring loaded ottoman 186 is shown in an enlarged view in FIG. 19A. As shown, a mounting link 134A is pivotally coupled to the main ottoman link 130 at pivot point 136A. The mounting link 134A is also pivotally coupled to the inside ottoman link 146 at pivot point 148A. The mounting link 134A is pivotally coupled to a bracket 138A at pivot point 188. The bracket 138A is constrained by a connection to the mounting link 134A through an arcuate slotted connection 140A. An ottoman bracket 142A is pivotally coupled to the bracket 138A at a pivot point 144A. As shown in FIG. 19A, a spring 190 may be coupled to a portion of the ottoman bracket 142A and to an end of the mounting link 134A. (Note that this spring would be present in the aspect shown and described above with respect to FIGS. 1-8 even though the spring is not shown in FIGS. 1-8). The main difference in the modified spring loaded ottoman 186 is that the bracket 138A is outside of the mounting link 134A, as compared to the footrest linkage assembly 12 described above with respect to FIGS. 1-8. This configuration allows additional space for a spring-loaded ottoman with a mid-ottoman design, as can be seen by comparing the spacing (W1) in FIG. 1 with the spacing (W2) in FIG. 19A.

Yet another aspect of the recliner mechanism 10 is shown in FIGS. 20-30. In this aspect, a two motor system is used that allows a variable pitch seat in any of the closed position, the TV position and the fully reclined position. In the aspect shown, the back linkage assembly is similar to that shown in FIGS. 1-8, as are many of the links. Unless specifically mentioned otherwise below, the links and couplings are the same as those described with respect to FIGS. 1-8.

Figure 20:
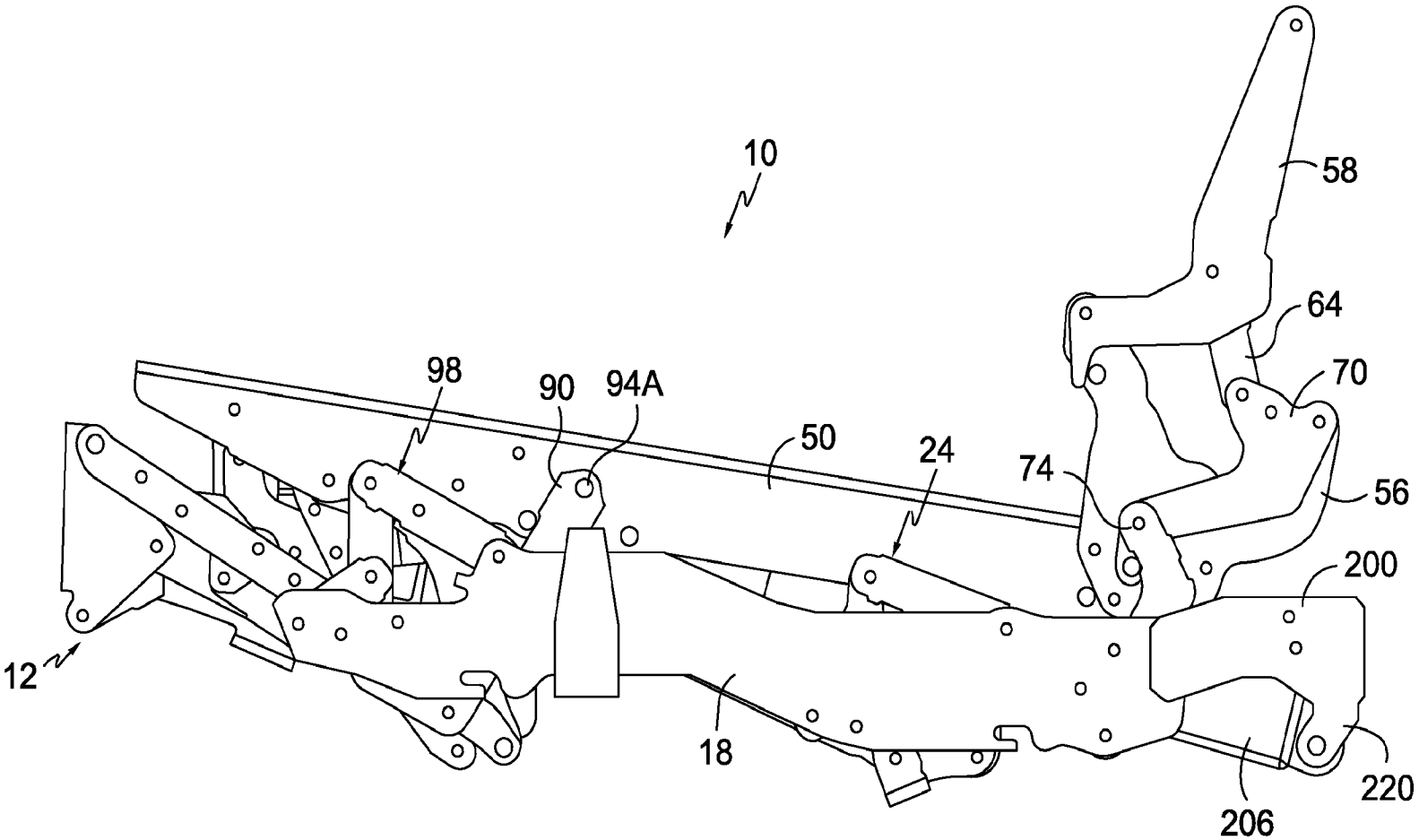
FIG. 20 is a side view of another aspect of a recliner mechanism in the closed position, in accordance with aspects hereof.
Figure 21:
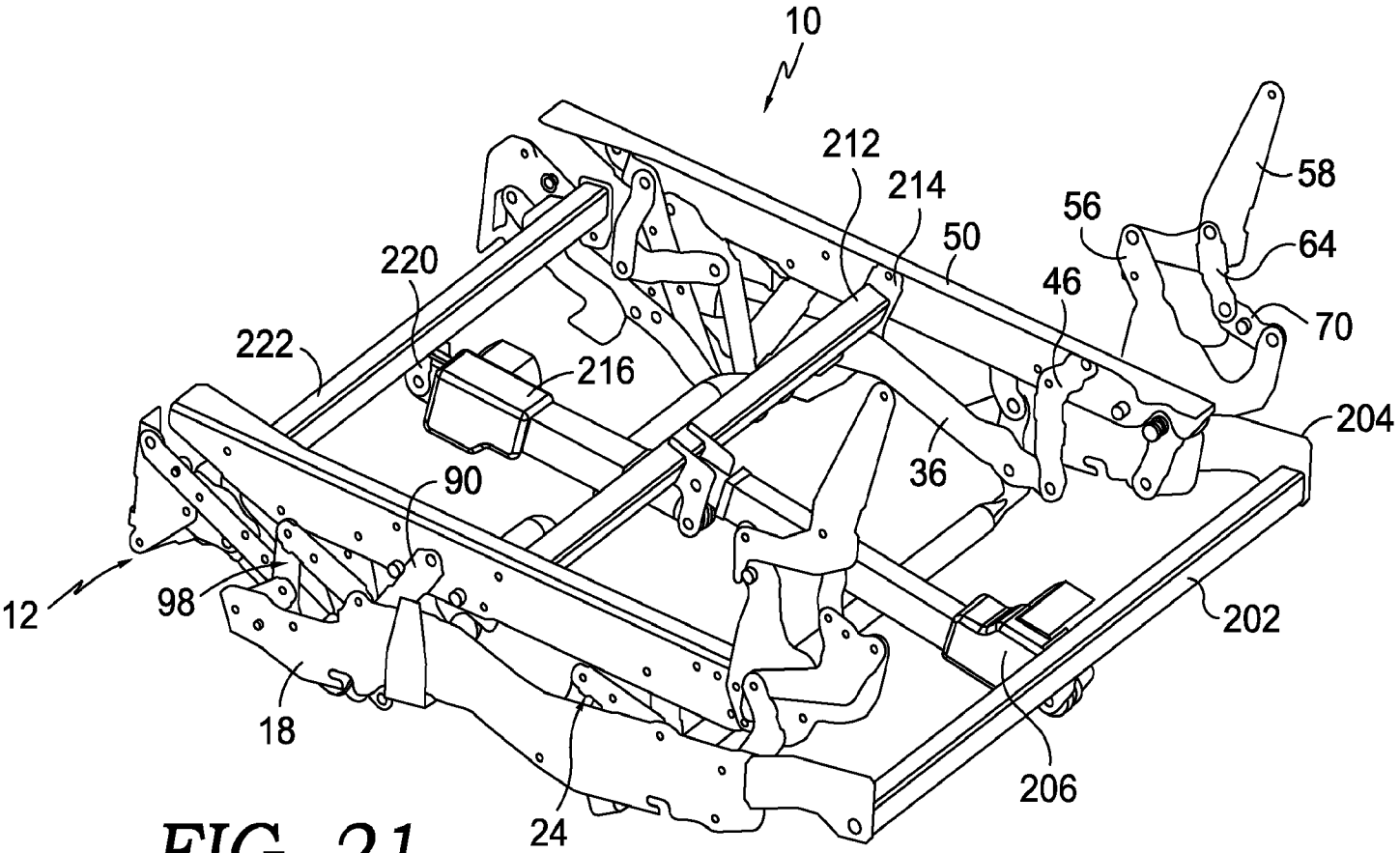
FIG. 21 is a perspective view of the mechanism of FIG. 20, in accordance with aspects hereof.
Figure 30:
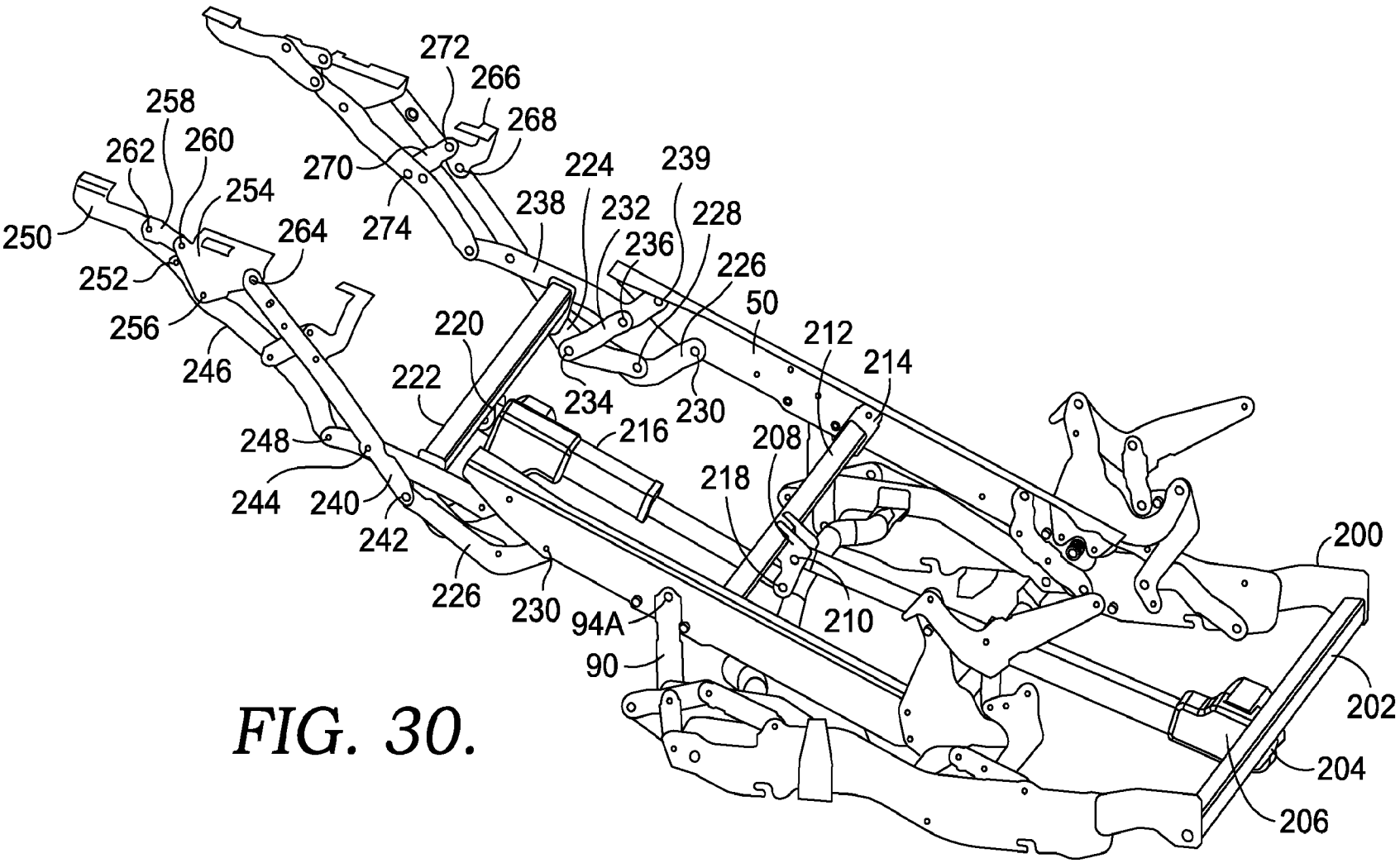
FIG. 30 is a perspective view of the mechanism of FIG. 29, in accordance with aspects hereof.

In this aspect, the footrest drive link 124 of the aspect shown in FIGS. 1-8 is eliminated. As shown in FIG. 20, an extended rear motor bracket 200 is fixedly coupled to the base plate 18 that extends rearwardly more than the motor bracket 84 of FIGS. 1-6. A rear motor tube 202 is fixedly coupled to and between opposed motor brackets 200, as best seen in FIG. 30. A clevis 204 is coupled to the rear motor tube 202 and is used to pivotally couple one end of a motor 206 to the rear motor tube 202. The end of the extending shaft of the motor 206 is pivotally coupled to a mid-motor bracket 208 at pivot point 210. The mid-motor bracket 208 is fixedly coupled to a mid-motor tube 212 that is coupled between brackets 214 fixedly mounted on seat rail 50. In other words, the mid-motor tube 212 is coupled to, and extends between, opposing seat rails 50.

With continued reference to FIG. 30, a second motor 216 has an extending shaft that is pivotally coupled to the mid-motor bracket 208 at pivot point 218. The other end of the motor 216 is pivotally coupled to a clevis 220 that is, in turn coupled to a front motor tube 222. The front motor tube 222 is coupled to a motor link 224 such that the front motor tube 222 extends from one motor link 224 to another. The motor link 224 extends away from the front motor tube 222 and is pivotally coupled to a rear ottoman link 226 at pivot point 228. The rear ottoman link 226 is also pivotally coupled to the seat rail 50 at pivot point 230. A control link 232 is pivotally coupled on one end to the motor link 224 at pivot point 234 and on the other end to a front ottoman link 238 at pivot point 236. The front ottoman link 238 is pivotally coupled to the seat rail 50 at pivot point 239.

The end of the rear ottoman link 226 opposite pivot point 230 is pivotally coupled to a main ottoman link 240 at pivot point 242, and the main ottoman link 240 is also pivotally coupled to the front ottoman link 238 at pivot point 244. The end of the front ottoman link 238 opposite pivot point 240 is pivotally coupled to an inside ottoman link 246 at pivot point 248. The end of the inside ottoman link 246 opposite pivot point 248 is pivotally coupled to a flipper ottoman link 250 at pivot point 252. Near pivot point 252, an ottoman bracket 254 is pivotally coupled to inside ottoman link 246 at pivot point 256. The ottoman bracket 254 is pivotally coupled to a control link 258 at pivot point 260, and the other end of the control link 258 is pivotally coupled to the flipper ottoman 250 at pivot point 262. The ottoman bracket 254 is also pivotally coupled to the main ottoman link 240 at pivot point 264. A mid-ottoman bracket 266 is pivotally coupled to the main ottoman link 240 at pivot point 268. The mid-ottoman bracket 266 is also pivotally coupled to a control link 270 at pivot point 272. The other end of the control link 270 is pivotally coupled to the inside ottoman link 246 at pivot point 274.

Figure 22:
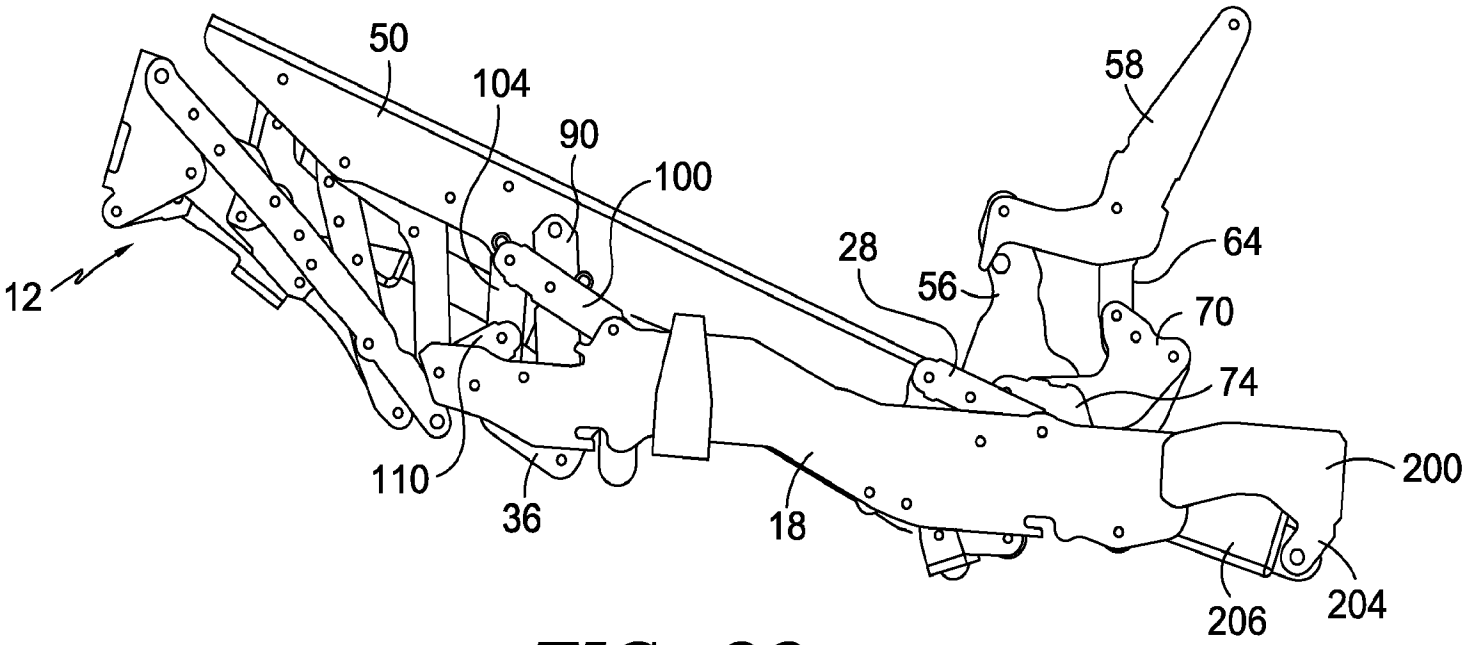
FIG. 22 is a side view, similar to FIG. 20, but with the seat pitch adjusted, in accordance with aspects hereof.
Figure 23:
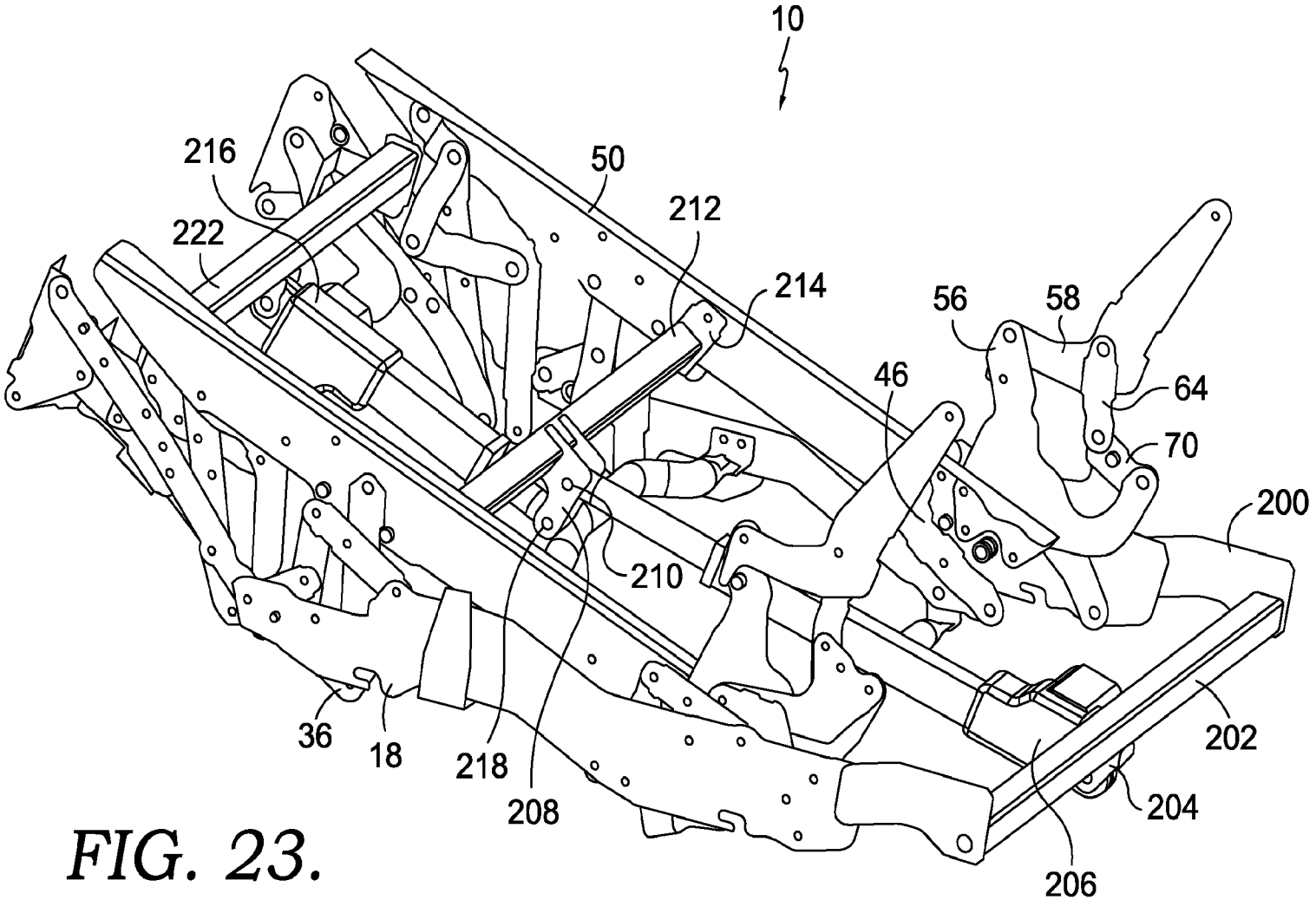
FIG. 23 is a perspective view of the mechanism of FIG. 22, in accordance with aspects hereof.
Figure 24:
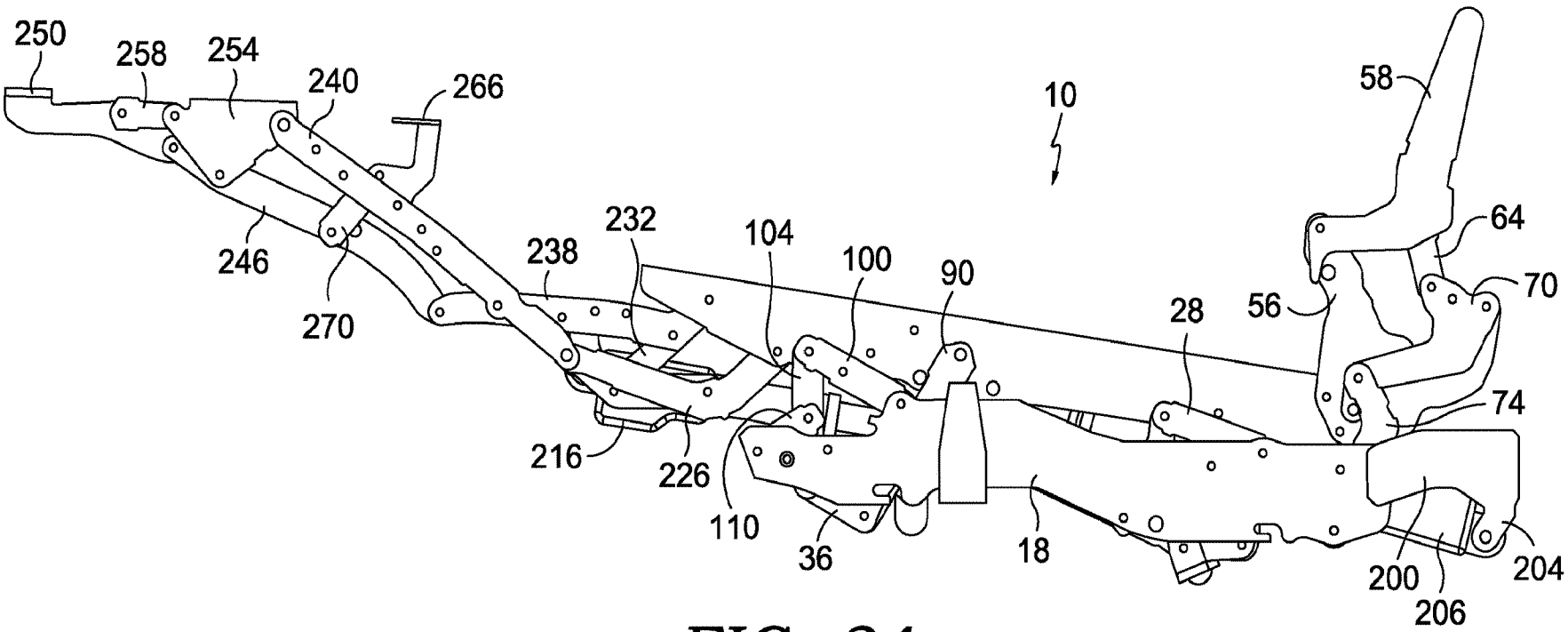
FIG. 24 is a side view of the mechanism of FIG. 20, in the TV position, in accordance with aspects hereof.
Figure 25:
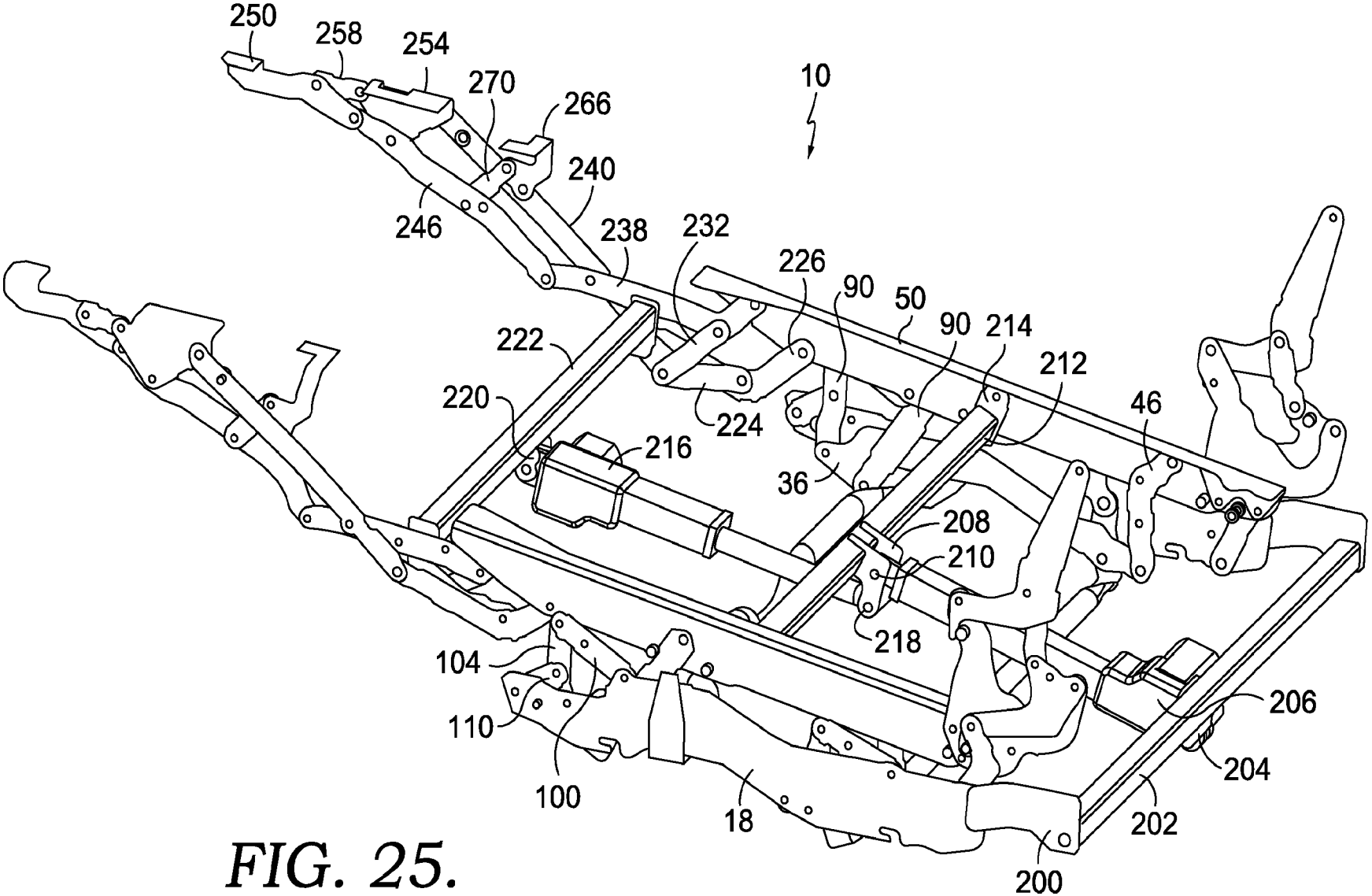
FIG. 25 is a perspective view of the mechanism of FIG. 24, in accordance with aspects hereof.
Figure 26:
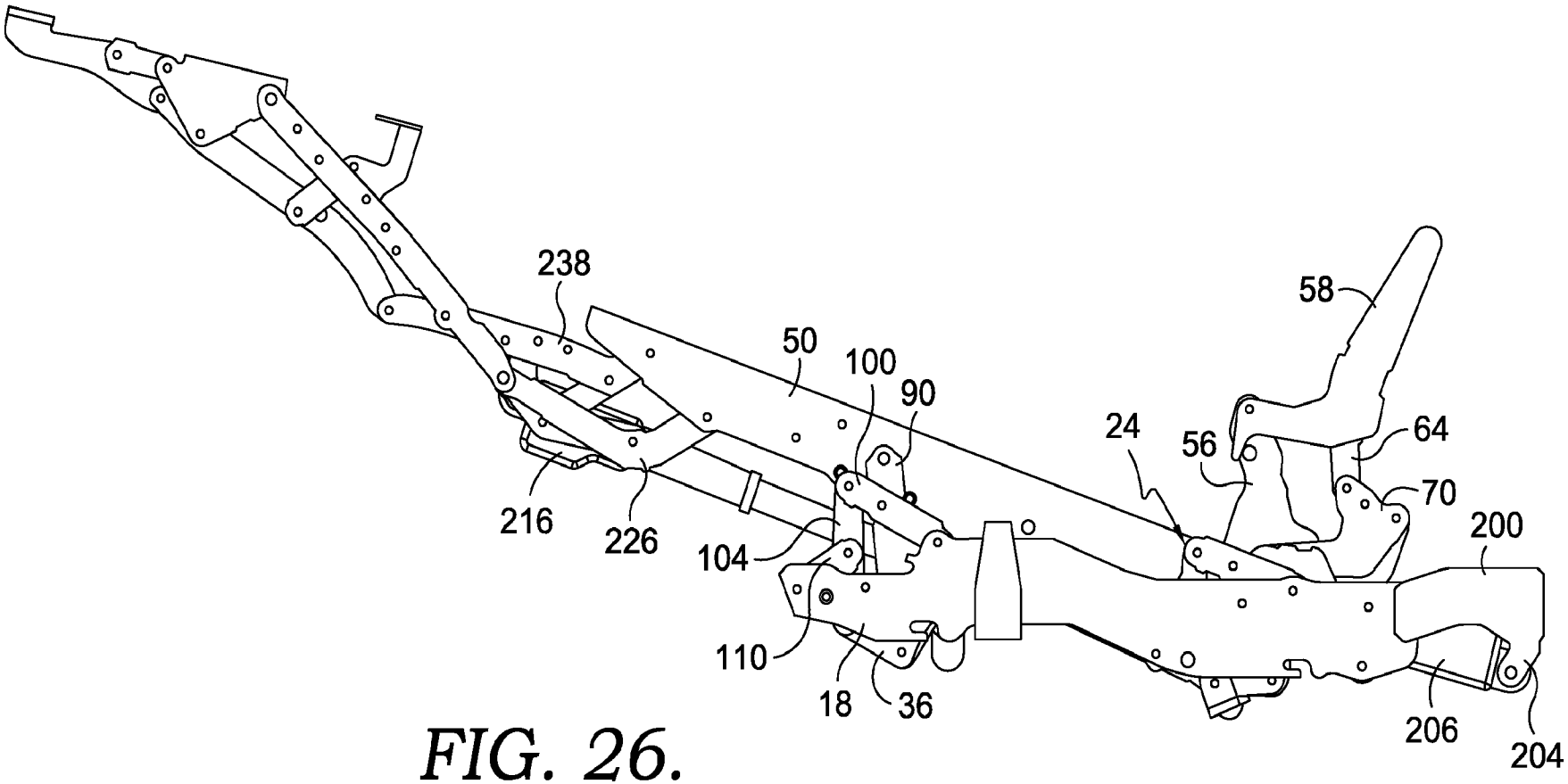
FIG. 26 is a side view similar to FIG. 24, but with the seat pitch adjusted, in accordance with aspects hereof.
Figure 27:
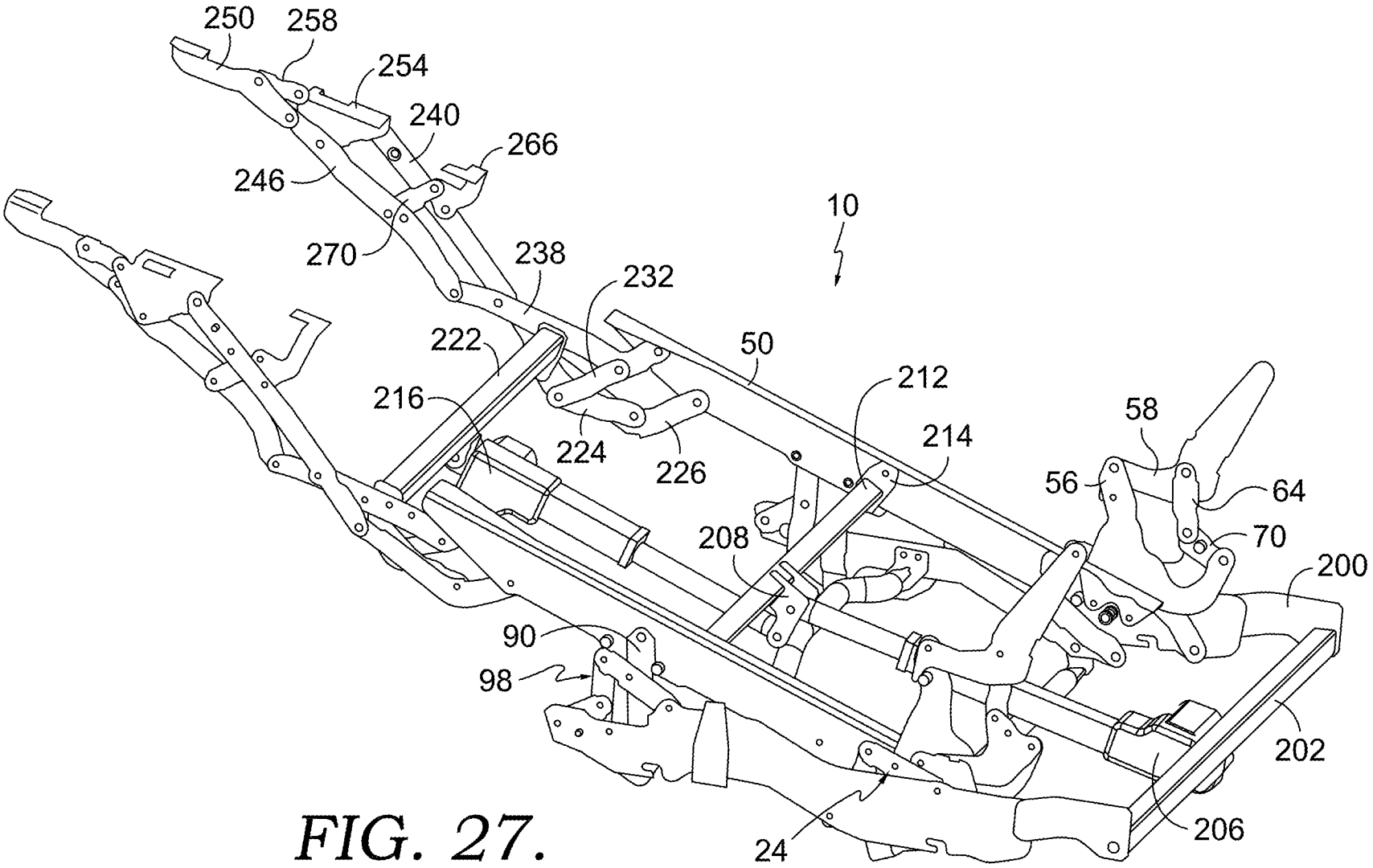
FIG. 27 is a perspective view of the mechanism of FIG. 26, in accordance with aspects hereof.
Figure 28:
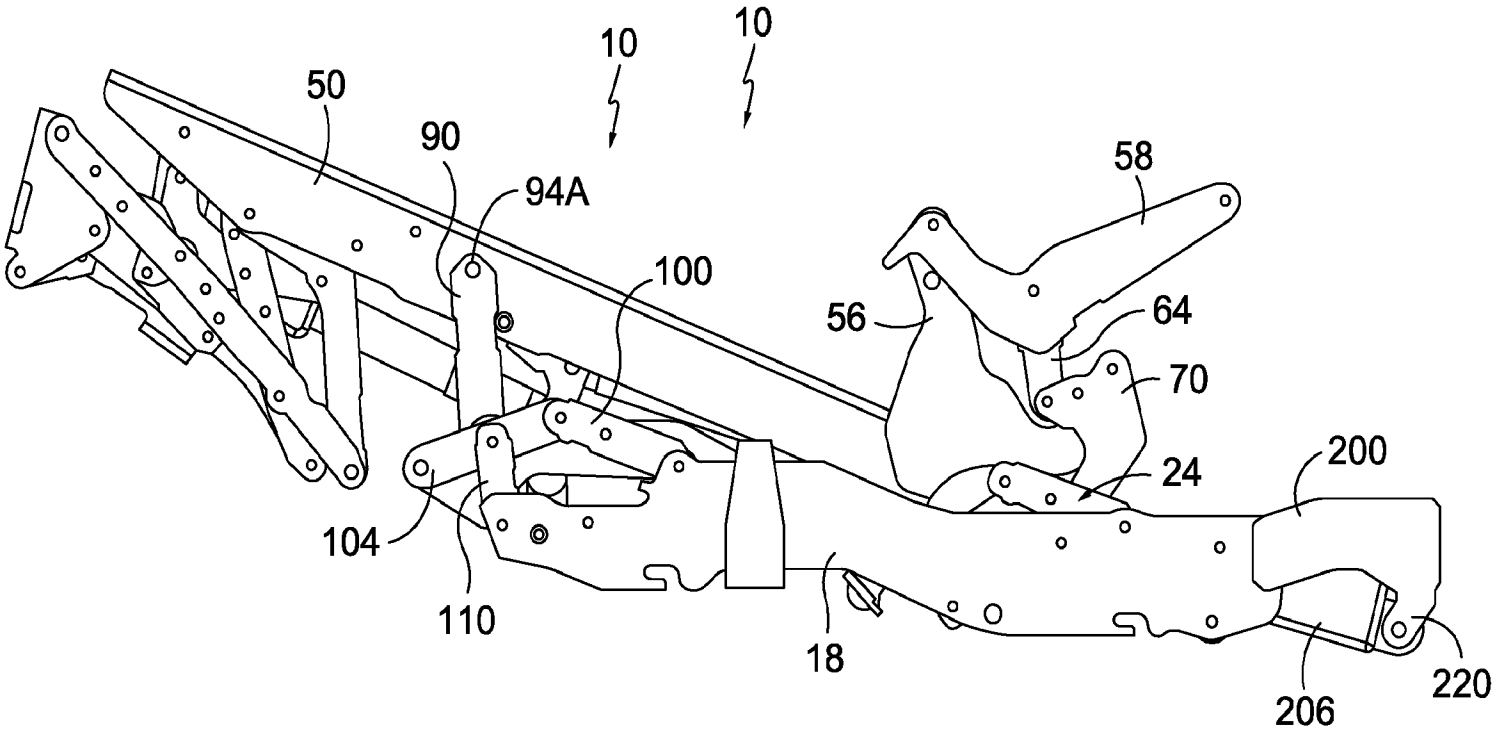
FIG. 28 is a side view similar to FIG. 22, but with the back fully reclined, in accordance with aspects hereof.
Figure 29:
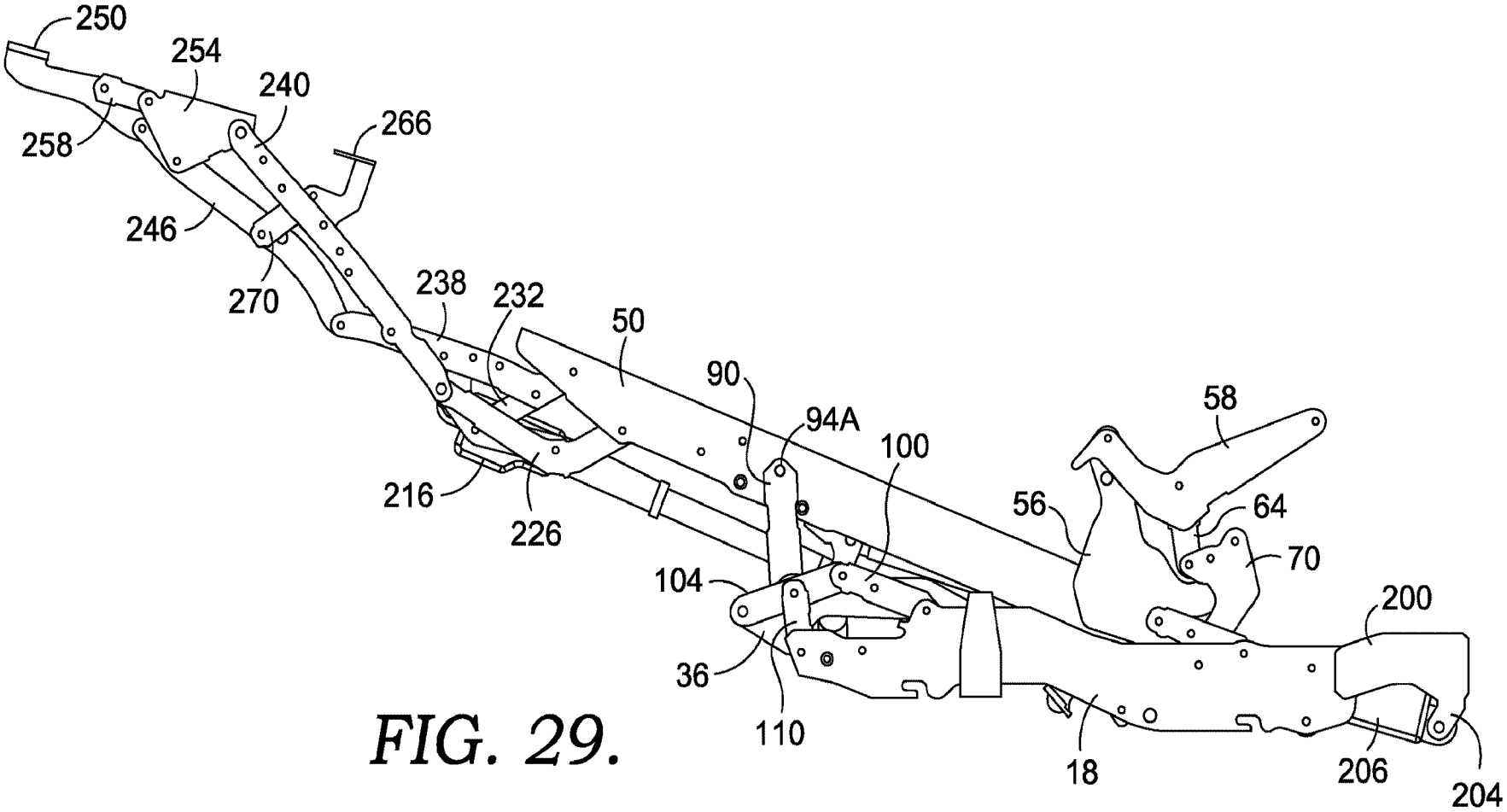
FIG. 29 is a side view of the mechanism of FIG. 20 with the seat pitch adjusted and in the fully reclined position, in accordance with aspects hereof.

As best seen in FIG. 20, in the aspect of FIGS. 20-30, the front pivot link 90 is located in pivot point 94A, allowing for increased pitch of seat rail 50. As seen in FIGS. 22 and 23, the motor 206 can be activated to extend the shaft of the motor 206 to change the pitch of the seat rail 50, guided by the front pivot link 90 and the rear pivot link 46. This can be done without extending the footrest linkage. In the aspect of FIGS. 20-30, the recliner mechanism 10 can also be moved from the closed position of FIG. 20 to the TV position shown in FIGS. 24 and 25 without increasing the pitch of the seat rail 50, by extending the shaft of the motor 216. Further, the recliner mechanism 10 can also be moved from the closed position of FIG. 20 to the TV position and additionally increasing the pitch of the seat rail 50, by extending the shaft of the motor 216 and extending the shaft of the motor 206, to the position shown in FIGS. 26 and 27. Additionally, as shown in FIG. 28, the recliner mechanism 10 can be moved with an increased pitch on the seat rail 50 and the back fully reclined, but the footrest in the closed position, by extending the shaft of the motor 206 fully, to achieve the position shown in FIG. 28. Finally, the recliner mechanism 10 can be positioned in a fully reclined position, with an increased pitch on the seat rail 50, by extending the shafts of the motor 206 and the motor 216 fully, to the position shown in FIGS. 29 and 30.

Figure 31A:
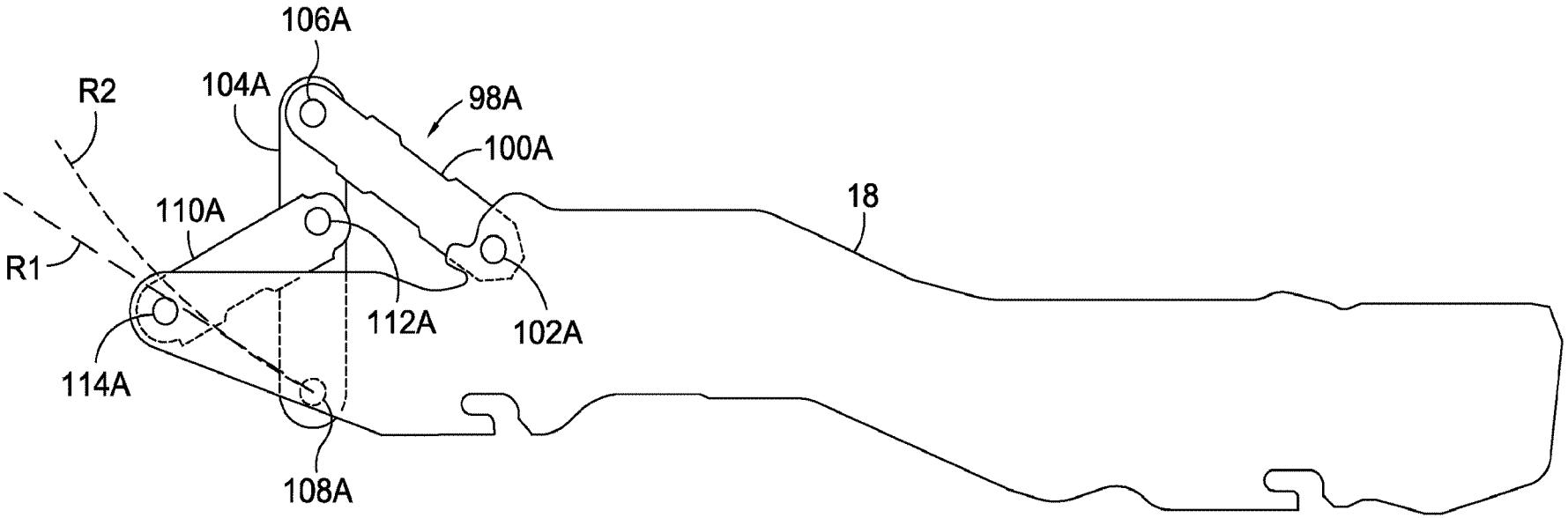
FIGS. 31A-31C depict a modified front sub-linkage, in accordance with aspects hereof.
Figure 31B:
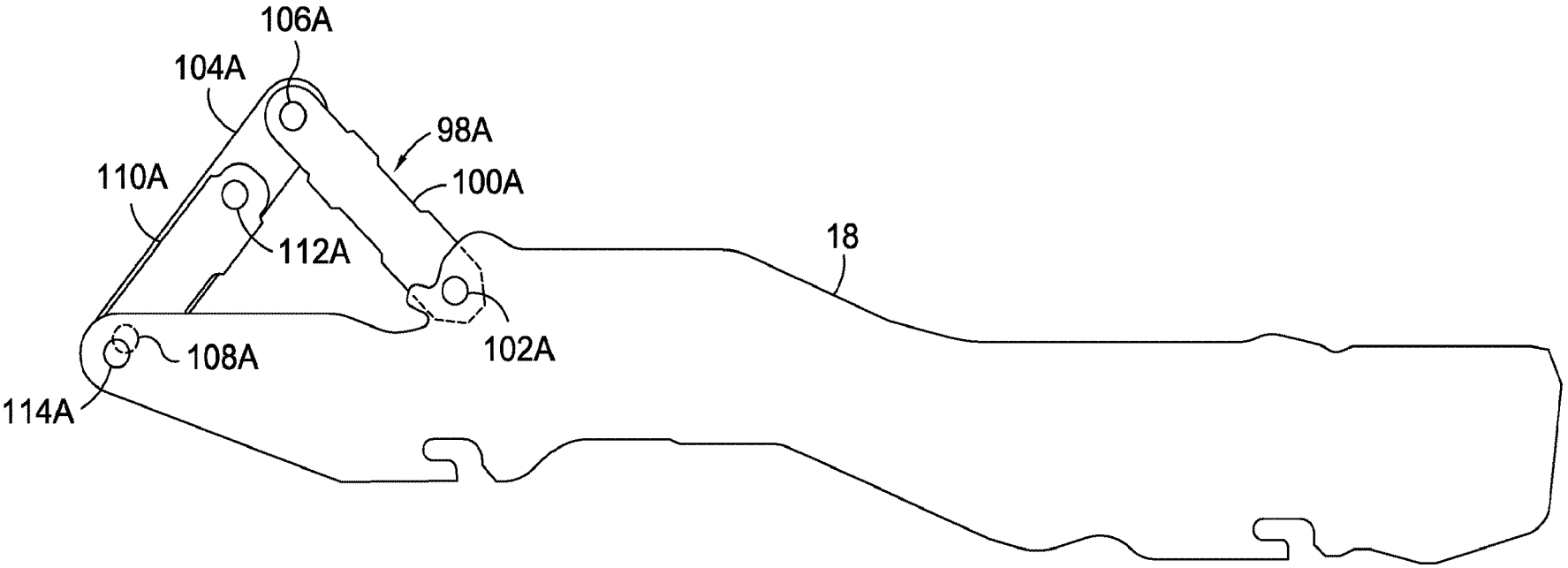
Figure 31C:
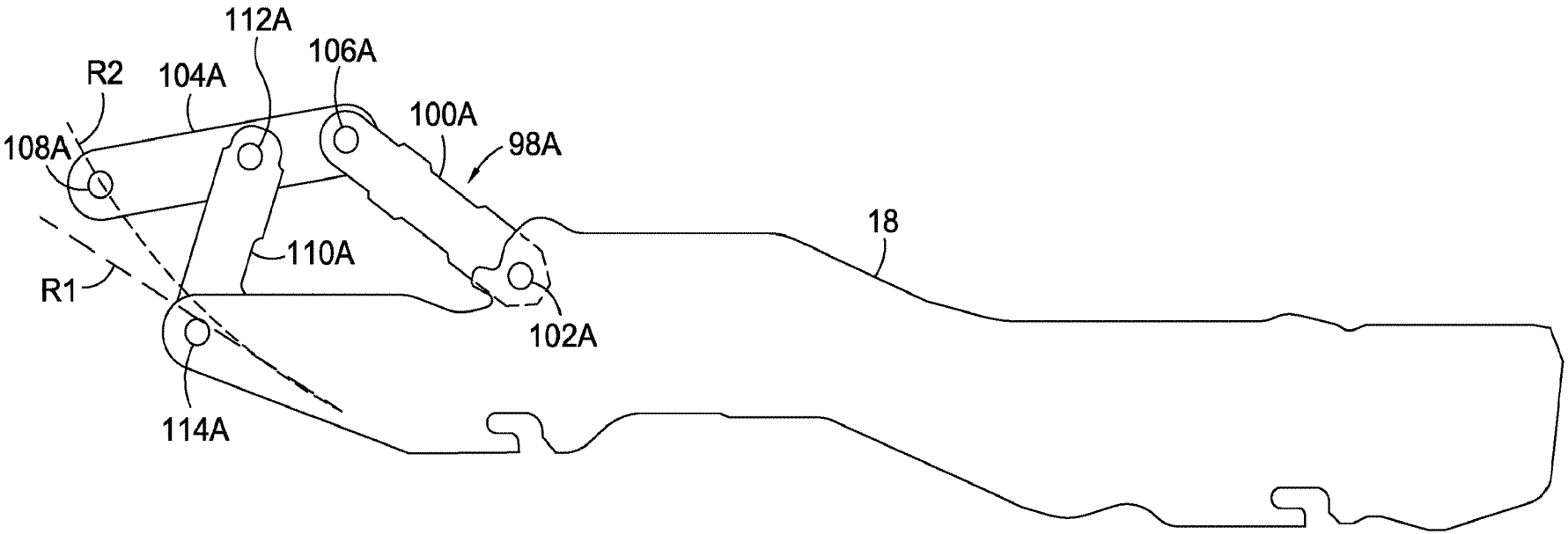

As shown in FIGS. 31A-31C, a modified front sub-linkage 98A may be used to provide additional seat pitch as the seating unit moves from the TV position to the fully-reclined position. The front sub-linkage 98A includes a toggle link 100A that is pivotally coupled on one end to the base plate 18 at pivot point 102A. The other end of the toggle link 100A is pivotally coupled to a front travel link 104A at pivot point 106A. The end of the front travel link 104A opposite pivot point 106A is pivotally coupled to the trolley link 36 (not shown) at pivot point 108A. Generally mid-way between pivot point 106A and pivot point 108A, the front travel link 104A is pivotally coupled to a pivot control link 110A at pivot point 112A. As compared to the front sub-linkage 98, in the front linkage 98A, the pivot point 112A is nearer to pivot point 106A than pivot point 112 to pivot point 106. The pivot control link 110A is longer than pivot control link 112 to accommodate this connection. The end of the pivot control link 110A opposite pivot point 112A is pivotally coupled to the base plate 18 at pivot point 114A. This modified geometry on the front sub-linkage 98A controls the movement of the front of the seat rail 50 in a curved line as the mechanism moves from the TV position to the fully-reclined position. Moreover, the front of the seat rail 50 is raised more with the front sub-linkage 98A as compared to the front sub-linkage 98. This can be seen by comparing reference line R1 in FIG. 31C (which is the path achieved using front sub-linkage 98) with the curved reference line R2 (which is the path achieved using modified front sub-linkage 98A). The shallower initial part of the curved path of pivot point 108A (e.g. going from the point shown in FIG. 31A to the point shown in FIG. 31B) allows a lower load on the motor in the initial stages of moving from the TV to the fully-reclined position, with the steeper path of the curve occurring in the later stages of moving from the TV to the fully-reclined position.

Each of the aspects of the recliner mechanism described with respect to FIGS. 1-31 provides a simplified, compact, recliner mechanism which can be adapted to many types of recliner design. The front linkage assembly and the rear linkage assembly provide the desired movement of the seat and back when moving from the TV position to the fully reclined position, obviating the need for a track and roller design, and all the deficiencies associated therewith. Moreover, the front pivot link and the rear pivot link are provided and oriented in a manner that allows the desired forward seat movement as the recliner moves from the closed position to the TV position. The geometries of the front linkage assembly, the rear linkage assembly, the front pivot link and the rear pivot link allow a slim profile design allowing great flexibility in the design of the recliner.

With only minimal changes the recliner mechanism described above allows for an increase in seat pitch (to allow positioning in a "zero-gravity" position with the front of the seat moving upwardly more than the rear of the seat in the TV and fully reclined positions). Similarly minimal changes allow a "high-ottoman" design (as shown in FIGS. 20-30), a spring-loaded ottoman design, a "deep seat" design (shown in FIGS. 14-19), and a design with either a short back or a long back. In other aspects, a two-motor design is possible that allows a variable seat pitch, with independent movement of the footrest linkage from the seat and the back (shown in FIGS. 20-30). Some aspects of this disclosure have been described with respect to the examples provided in the figures.

Additional aspects of the disclosure will now be described that may be related subject matter included in one or more claims or clauses of this application at the time of filing, or one or more related applications, but the claims or clauses are not limited to only the subject matter described in the below portions of this description. These additional aspects may include features illustrated by the figures, features not illustrated by the figures, and any combination thereof. When describing these additional aspects, reference may be made to elements depicted by the figures for illustrative purposes.

As used herein and in connection with the claims listed hereinafter, the terminology "any of clauses" or similar variations of said terminology is intended to be interpreted such that features of claims/clauses may be combined in any combination. For example, an exemplary clause 4 may indicate the method/apparatus of any of clauses 1 through 3, which is intended to be interpreted such that features of clause 1 and clause 4 may be combined, elements of clause 2 and clause 4 may be combined, elements of clause 3 and 4 may be combined, elements of clauses 1, 2, and 4 may be combined, elements of clauses 2, 3, and 4 may be combined, elements of clauses 1, 2, 3, and 4 may be combined, and/or other variations.

The following clauses are aspects contemplated herein.

Clause 1. An all-linkage mechanism for a seating unit, the all-linkage mechanism controlling movement of the seating unit between closed, TV and fully-reclined positions, the mechanism comprising: a base plate fixedly coupled to the seating unit; a seat rail movably coupled to the base plate; a front sub-linkage pivotally coupled to the base plate at least at two locations; a rear sub-linkage pivotally coupled to the base plate at least at two locations; a trolley link pivotally coupled to, and extending between, the front sub-linkage and the rear sub-linkage; a front pivot link pivotally coupled on a first end to the seat rail, and pivotally coupled on a second end to the trolley link; a rear pivot link pivotally coupled on a first end to the seat rail, and pivotally coupled on a second end to the trolley link; a motor pivotally coupled on one end to a rear motor tube fixedly coupled to one of the base plate or the seating unit, and pivotally coupled on the other end to a front motor tube coupled to a link on the mechanism; wherein the motor, when activated moves the seating unit between closed, TV and fully-reclined positions, and the front pivot link and the rear pivot link move the seat rail forwardly as the motor moves the seating unit from the closed position to the TV position.

Clause 2. The mechanism of clause 1, wherein the front sub-linkage and the rear sub-linkage control the movement of the seat rail and move the seat rail farther forward as the seating unit moves from the TV to the fully-reclined position.

Clause 3. The mechanism of any of clauses 1-2, wherein the front sub-linkage and the rear sub-linkage are independently coupled to the base plate with respect to one another.

Clause 4. The mechanism of any of clauses 1-3, wherein the front sub-linkage comprises: a front pivot control link having a first end pivotally coupled to the base plate and a second end spaced from the first end of the front pivot control link; a front travel link having a first end pivotally coupled to the trolley link and a second end spaced from the first end of the front travel link, the second end of the front pivot control link pivotally coupled to the front travel link between the first end of the front travel link and the second end of the front travel link; and a front toggle link having a first end pivotally coupled to the base plate and a second end pivotally coupled to the second end of the front travel link.

Clause 5. The mechanism of any of clauses 1-4, wherein the distance from the pivotal connection between the front pivot control link and the base plate to the pivotal connection between the front pivot control link and the front travel link is equal to the distance from the pivotal connection between the front pivot control link and the front travel link to the pivotal connection between the front travel link and the trolley link.

Clause 6. The mechanism of any of clauses 1-5, wherein a line, extending from the pivotal connection between the front travel link and the trolley link to the pivotal connection between the front toggle link and the base plate when the seating unit is in a closed position, defines a front line of travel of the pivotal connection between the front travel link and the trolley link as the seating unit moves from the TV position to the fully-reclined position.

Clause 7. The mechanism of any of clauses 1-6, wherein the front line of travel is a straight line.

Clause 8. The mechanism of any of clauses 1-5, wherein the front sub-linkage moves the pivotal connection between the front travel link and the trolley link in an arcuate line of travel as the seating unit moves from the TV position to the fully-reclined position Clause 9. The mechanism of any of clauses 1-8, wherein the rear sub-linkage comprises: a rear pivot control link having a first end pivotally coupled to the base plate and a second end spaced from the first end of the rear pivot control link; a rear travel link having a first end pivotally coupled to the trolley link and a second end spaced from the first end of the rear travel link, the second end of the rear pivot control link pivotally coupled to the rear travel link between the first end of the rear travel link and the second end of the rear travel link; and a rear toggle link having a first end pivotally coupled to the base plate and a second end pivotally coupled to the second end of the rear travel link.

Clause 10. The mechanism of any of clauses 1-9, wherein the distance from the pivotal connection between the rear pivot control link and the base plate to the pivotal connection between the rear pivot control link and the rear travel link is equal to the distance from the pivotal connection between the rear pivot control link and the rear travel link to the pivotal connection between the rear travel link and the trolley link.

Clause 11. The mechanism of any of clauses 1-10, wherein a line, extending from the pivotal connection between the rear travel link and the trolley link to the pivotal connection between the rear toggle link and the base plate when the seating unit is in a closed position, defines a rear line of travel of the pivotal connection between the rear travel link and the trolley link as the seating unit moves from the TV position to the fully-reclined position.

Clause 12. The mechanism of any of clauses 1-11, wherein the rear line of travel is a straight line.

Clause 13. The mechanism of any of clauses 1-12, wherein the front line of travel is not parallel to the rear line of travel to allow the pitch of the seat rail to change as the seating unit moves from the TV position to the fully-reclined position.

Clause 14. The mechanism of any of clauses 1-13, wherein the seat rail has a first connection hole for the front pivot link and a second connection hole for the front pivot link that is located on the seat rail rearwardly and below the first connection hole; and wherein the front pivot link may be pivotally coupled to the seat rail in either of the first connection hole or the second connection hole; and wherein when the front pivot link is pivotally coupled to the seat rail at the first connection hole the pitch of the seat rail from front to back increases by a first amount as the seating unit moves from the closed position to the TV position; and wherein when the front pivot link is pivotally coupled to the seat rail at the second connection hole the pitch of the seat rail from front to back increases by a second amount as the seating unit moves from the closed position to the TV position; and wherein the second amount is greater than the first amount.

Clause 15. The mechanism of any of clauses 1-14, wherein the rear motor tube is fixedly coupled directly to the base plate on one end, and pivotally coupled on the other end to a link on the mechanism.

Clause 16. The mechanism of any of clauses 1-15, further comprising a base plate extension fixedly coupled to a rear end of the base plate and extending rearwardly from the base plate, and wherein the rear motor tube is fixedly coupled to the base plate extension to allow a deep seat for the seating unit.

Clause 17. The recliner mechanism of any of clauses 1-16, further comprising: a first back linkage, the first back linkage comprising: a first rear seat bracket fixedly coupled to the seat rail; a first back bracket configured to support a long back on the seating unit, the back bracket pivotally coupled to the rear seat bracket; and a first back recline linkage pivotally coupled to the first back bracket, the first rear seat bracket and the base plate, the first back recline linkage controlling the recline of the long back on the seating unit.

Clause 18. The recliner mechanism of any of clauses 1-17, further comprising: a second back linkage, the second back linkage replacing the first back linkage and comprising a second rear seat bracket fixedly coupled to the seat rail; a second back bracket configured to support a short back on the seating unit, the second back bracket pivotally coupled to the second rear seat bracket; and a second back recline linkage pivotally coupled to the second back bracket, the second rear seat bracket and the base plate, the second back recline linkage controlling the recline of the short back on the seating unit.

Clause 19. The mechanism of any of clauses 1-18, wherein the first motor is coupled on the end opposite the rear motor tube to a mid-motor tube instead of the front motor tube, the mid-motor tube fixedly coupled to the seat rail, the mechanism further comprising a second motor, the second motor having one end coupled to the mid-motor tube and an opposite end coupled to a front motor tube coupled to a link on the mechanism, wherein the first motor may be activated to independently adjust the pitch of the seat rail and wherein the second motor may be activated to independently move the seating unit between the closed, TV and fully-reclined positions.

Clause 20. A recliner mechanism, comprising: a pair of base plates; a pair of seat rails, one seat rail disposed above a corresponding base plate; a pair of trolley links, one trolley link indirectly coupled between a corresponding base plate and seat rail; a footrest linkage coupled to the seat rail; a back bracket pivotally coupled to the seat rail; a pair of front pivot links, one front pivot link pivotally coupled to a corresponding seat rail on one end and to a corresponding trolley link on the other end; a pair of rear pivot links, one rear pivot link pivotally coupled to a corresponding seat rail on one end and to a corresponding trolley link on the other end; a pair of footrest drive links, one footrest drive link pivotally coupled to a corresponding rear pivot link on one end and to a link on the footrest linkage on the other end wherein the recliner mechanism is moveable between a closed position, a TV position and a fully reclined position.

It will be understood that certain features and sub-combinations are of utility and may be employed without reference to other features or sub-combinations. This is contemplated by and is within the scope of the claims. The described technology may be made without departing from the scope, it is to be understood that all matter described herein or illustrated in the accompanying drawings is to be interpreted as illustrative and not in a limiting sense.

The present invention has been described in relation to particular examples, which are intended in all respects to be illustrative rather than restrictive. From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

Some aspects of this disclosure have been described with respect to the examples provided in the figures. Additional aspects of the disclosure will now be described that may be related subject matter included in one or more claims or clauses of this application at the time of filing, or one or more related applications, but the claims or clauses are not limited to only the subject matter described in the below portions of this description. These additional aspects may include features illustrated by the figures, features not illustrated by the figures, and any combination thereof. When describing these additional aspects, reference may be made to elements depicted by the figures for illustrative purposes.

What is claimed:

1. An all-linkage mechanism for a seating unit, the all-linkage mechanism controlling movement of the seating unit between closed, TV and fully-reclined positions, the mechanism comprising:

a base plate fixedly coupled to the seating unit;

a seat rail movably coupled to the base plate;

a front sub-linkage pivotally coupled to the base plate at least at two locations;

a rear sub-linkage pivotally coupled to the base plate at least at two locations;

a trolley link pivotally coupled to, and extending between, the front sub-linkage and the rear sub-linkage;

a front pivot link pivotally coupled on a first end to the seat rail, and pivotally coupled on a second end to the trolley link;

a rear pivot link pivotally coupled on a first end to the seat rail, and pivotally coupled on a second end to the trolley link;

a motor pivotally coupled on one end to a rear motor tube fixedly coupled to one of the base plate or the seating unit, and pivotally coupled on the other end to a front motor tube coupled to a link on the mechanism; and wherein the motor, when activated moves the seating unit between closed, TV and fully-reclined positions, and the front pivot link and the rear pivot link move the seat rail forwardly as the motor moves the seating unit from the closed position to the TV position.

2. The mechanism of claim 1, wherein the front sub-linkage and the rear sub-linkage control the movement of the seat rail and move the seat rail farther forward as the seating unit moves from the TV to the fully-reclined position.

3. The mechanism of claim 1, wherein the front sub-linkage and the rear sub-linkage are independently coupled to the base plate with respect to one another.

4. The mechanism of claim 1, wherein the front sub-linkage comprises:

a front pivot control link having a first end pivotally coupled to the base plate and a second end spaced from the first end of the front pivot control link;

a front travel link having a first end pivotally coupled to the trolley link and a second end spaced from the first end of the front travel link, the second end of the front pivot control link pivotally coupled to the front travel link between the first end of the front travel link and the second end of the front travel link; and a front toggle link having a first end pivotally coupled to the base plate and a second end pivotally coupled to the second end of the front travel link.

5. The mechanism of claim 2, wherein the distance from the pivotal connection between the front pivot control link and the base plate to the pivotal connection between the front pivot control link and the front travel link is equal to the distance from the pivotal connection between the front pivot control link and the front travel link to the pivotal connection between the front travel link and the trolley link.

6. The mechanism of claim 5, wherein a line, extending from the pivotal connection between the front travel link and the trolley link to the pivotal connection between the front toggle link and the base plate when the seating unit is in a closed position, defines a front line of travel of the pivotal connection between the front travel link and the trolley link as the seating unit moves from the TV position to the fully-reclined position.

7. The mechanism of claim 6, wherein the front line of travel is a straight line.

8. The mechanism of claim 5, wherein the front sub-linkage moves the pivotal connection between the front travel link and the trolley link in an arcuate line of travel as the seating unit moves from the TV position to the fully-reclined position.

9. The mechanism of claim 7, wherein the rear sub-linkage comprises:

a rear pivot control link having a first end pivotally coupled to the base plate and a second end spaced from the first end of the rear pivot control link;

a rear travel link having a first end pivotally coupled to the trolley link and a second end spaced from the first end of the rear travel link, the second end of the rear pivot control link pivotally coupled to the rear travel link between the first end of the rear travel link and the second end of the rear travel link; and a rear toggle link having a first end pivotally coupled to the base plate and a second end pivotally coupled to the second end of the rear travel link.

10. The mechanism of claim 9, wherein the distance from the pivotal connection between the rear pivot control link and the base plate to the pivotal connection between the rear pivot control link and the rear travel link is equal to the distance from the pivotal connection between the rear pivot control link and the rear travel link to the pivotal connection between the rear travel link and the trolley link.

11. The mechanism of claim 10, wherein a line, extending from the pivotal connection between the rear travel link and the trolley link to the pivotal connection between the rear toggle link and the base plate when the seating unit is in a closed position, defines a rear line of travel of the pivotal connection between the rear travel link and the trolley link as the seating unit moves from the TV position to the fully-reclined position.

12. The mechanism of claim 11, wherein the rear line of travel is a straight line.

13. The mechanism of claim 12, wherein the front line of travel is not parallel to the rear line of travel to allow the pitch of the seat rail to change as the seating unit moves from the TV position to the fully-reclined position.

14. The mechanism of claim 1, wherein the seat rail has a first connection hole for the front pivot link and a second connection hole for the front pivot link that is located on the seat rail rearwardly and below the first connection hole; and wherein the front pivot link may be pivotally coupled to the seat rail in either of the first connection hole or the second connection hole; and wherein when the front pivot link is pivotally coupled to the seat rail at the first connection hole the pitch of the seat rail from front to back increases by a first amount as the seating unit moves from the closed position to the TV position; and wherein when the front pivot link is pivotally coupled to the seat rail at the second connection hole the pitch of the seat rail from front to back increases by a second amount as the seating unit moves from the closed position to the TV position; and wherein the second amount is greater than the first amount.

15. The mechanism of claim 1, wherein the rear motor tube is fixedly coupled directly to the base plate on one end, and pivotally coupled on the other end to a link on the mechanism.

16. The mechanism of claim 1, further comprising a base plate extension fixedly coupled to a rear end of the base plate and extending rearwardly from the base plate, and wherein the rear motor tube is fixedly coupled to the base plate extension to allow a deep seat for the seating unit.

17. The recliner mechanism of claim 1, further comprising:

a first back linkage, the first back linkage comprising:

a first rear seat bracket fixedly coupled to the seat rail;

a first back bracket configured to support a long back on the seating unit, the back bracket pivotally coupled to the rear seat bracket; and a first back recline linkage pivotally coupled to the first back bracket, the first rear seat bracket and the base plate, the first back recline linkage controlling the recline of the long back on the seating unit.

18. The recliner mechanism of claim 17, further comprising:

a second back linkage, the second back linkage replacing the first back linkage and comprising:

a second rear seat bracket fixedly coupled to the seat rail;

a second back bracket configured to support a short back on the seating unit, the second back bracket pivotally coupled to the second rear seat bracket; and a second back recline linkage pivotally coupled to the second back bracket, the second rear seat bracket and the base plate, the second back recline linkage controlling the recline of the short back on the seating unit.

19. The mechanism of claim 1, wherein the first motor is coupled on the end opposite the rear motor tube to a mid-motor tube instead of the front motor tube, the mid-motor tube fixedly coupled to the seat rail, the mechanism further comprising a second motor, the second motor having one end coupled to the mid-motor tube and an opposite end coupled to a front motor tube coupled to a link on the mechanism, wherein the first motor may be activated to independently adjust the pitch of the seat rail and wherein the second motor may be activated to independently move the seating unit between the closed, TV and fully-reclined positions.

20. A recliner mechanism, comprising:

a pair of base plates;

a pair of seat rails, one seat rail disposed above a corresponding base plate;

a pair of trolley links, one trolley link indirectly coupled between a corresponding base plate and seat rail;

a footrest linkage coupled to the seat rail;

a back bracket pivotally coupled to the seat rail;

a pair of front pivot links, one front pivot link pivotally coupled to a corresponding seat rail on one end and to a corresponding trolley link on the other end;

a pair of rear pivot links, one rear pivot link pivotally coupled to a corresponding seat rail on one end and to a corresponding trolley link on the other end;

a pair of footrest drive links, one footrest drive link pivotally coupled to a corresponding rear pivot link on one end and to a link on the footrest linkage on the other end;

wherein the recliner mechanism is moveable between a closed position, a TV position and a fully reclined position.

* * * * *